US008887603B2

(12) United States Patent
Yuyama et al.

(10) Patent No.: US 8,887,603 B2
(45) Date of Patent: Nov. 18, 2014

(54) TABLET FEEDER

(75) Inventors: Shoji Yuyama, Toyonaka (JP); Naoki Koike, Toyonaka (JP); Mitsuhiro Mitani, Toyonaka (JP); Masao Fukada, Toyonaka (JP)

(73) Assignee: Yuyama Mfg. Co., Ltd. (JP)

( * ) Notice: Subject to any disclaimer, the term of this patent is extended or adjusted under 35 U.S.C. 154(b) by 685 days.

(21) Appl. No.: 13/119,626

(22) PCT Filed: Sep. 14, 2009

(86) PCT No.: PCT/JP2009/004564

§ 371 (c)(1),
(2), (4) Date: Mar. 17, 2011

(87) PCT Pub. No.: WO2010/032418

PCT Pub. Date: Mar. 25, 2010

(65) Prior Publication Data

US 2011/0170655 A1 Jul. 14, 2011

(30) Foreign Application Priority Data

Sep. 18, 2008 (JP) ..... 2008-239780
Mar. 5, 2009 (JP) ..... 2009-051850
Jul. 29, 2009 (JP) ..... 2009-175990

(51) Int. Cl.
*B27B 31/08* (2006.01)
*G07F 11/66* (2006.01)
*G07F 17/00* (2006.01)

(52) U.S. Cl.
CPC ..... *G07F 17/0092* (2013.01); *G07F 11/66* (2013.01)
USPC ..... 83/104; 83/105; 221/30; 221/265

(58) Field of Classification Search
USPC ..... 83/104, 105, 23, 418, 27, 99; 221/30, 221/263, 265, 277; 206/540
See application file for complete search history.

(56) References Cited

U.S. PATENT DOCUMENTS 4,903,861 A * 2/1990 Yuyama ..... 221/265
5,481,855 A * 1/1996 Yuyama ..... 53/493

(Continued)

FOREIGN PATENT DOCUMENTS

JP 62-50094 3/1987
JP 2-29257 1/1990

(Continued)

OTHER PUBLICATIONS

International Search Report-PCT/JP2009/004564 dated Jan. 19, 2010.

*Primary Examiner* — Omar Flores Sanchez
(74) *Attorney, Agent, or Firm* — Cantor Colburn LLP

(57) ABSTRACT

A tablet T is divided without moving a cutter and divided tablets T1, T2 are fed one by one. A rotor 24 is installed in a container 21 receiving the tablets T. A rotor receiving part of the container has a barrel shape with a bottom section formed with a discharge port 27, and a fixing blade 33 is installed outside the rotor receiving part. Recesses 25 are formed on an entire lateral side of the rotor at a regular interval to receive a tablet. A peripheral groove is formed on the entire lateral side of the rotor and a fixing blade and a support plate are inserted into the peripheral groove. The fixing blade divides the tablet, which is accommodated in the recess and move while being guided along an inner wall of the rotor receiving part as the rotor rotates. A lower divided tablet T1 is discharged to the discharge port 27 and an upper divided tablet T2 is kept on the fixing blade. The upper divided tablet is discharged as the rotor further rotates.

21 Claims, 36 Drawing Sheets

(56) References Cited

U.S. PATENT DOCUMENTS

| | | | | |
|---|---|---|---|---|
| 5,502,755 | A * | 3/1996 | Nagel et al. | 377/6 |
| 5,504,972 | A * | 4/1996 | Tada et al. | 15/404 |
| 5,671,592 | A * | 9/1997 | Yuyama et al. | 53/493 |
| 5,678,393 | A * | 10/1997 | Yuyama et al. | 53/493 |
| 6,690,760 | B2 * | 2/2004 | Kolster | 377/6 |
| 6,722,545 | B2 * | 4/2004 | Yuyama et al. | 225/96.5 |
| 6,938,530 | B1 * | 9/2005 | Fujimoto et al. | 83/420 |
| 7,451,676 | B2 * | 11/2008 | Thurston et al. | 83/409.1 |
| 2003/0034373 | A1 * | 2/2003 | Yuyama et al. | 225/96.5 |
| 2004/0149100 | A1 * | 8/2004 | Fujimoto et al. | 83/418 |
| 2006/0224274 | A1 * | 10/2006 | Broussard et al. | 700/225 |
| 2007/0154290 | A1 * | 7/2007 | McNaughton et al. | 414/160 |
| 2009/0049968 | A1 * | 2/2009 | Thurston et al. | 83/409.1 |
| 2011/0170655 | A1 * | 7/2011 | Yuyama et al. | 377/6 |
| 2011/0309101 | A1 * | 12/2011 | Kokie et al. | 221/30 |
| 2012/0324828 | A1 * | 12/2012 | Yasunaga et al. | 53/111 R |
| 2013/0125722 | A1 * | 5/2013 | Omura et al. | 83/104 |
| 2013/0247731 | A1 * | 9/2013 | Kim | 83/109 |

FOREIGN PATENT DOCUMENTS

| | | |
|---|---|---|
| JP | 11-226089 | 8/1999 |
| JP | 11226089 | 8/1999 |
| JP | 2003-63503 | 3/2003 |
| JP | 2005-59903 | 3/2005 |
| JP | 2005-272011 | 10/2005 |
| JP | 2006-306430 | 11/2006 |
| JP | 2007-75178 | 3/2007 |
| JP | 2008-162609 | 7/2008 |
| TW | 172942 | 11/1991 |
| TW | 524688 | 3/2003 |

* cited by examiner (a)

(b)

(a)

(b)

(a)

(b)

(c)

TABLET FEEDER

TECHNICAL FIELD

The present invention relates to a method of counting the number of feeding tablets when the tablets are prepared in hospitals, clinics or pharmacies and so on based on the prescription, and a tablet feeder to feed the tablets. More particularly, the present invention relates to a method of automatically dividing the tablet, a tablet division feeder to divide and feed the tablets, a pharmaceutical feeding (charging) apparatus including the tablet feeder or the tablet division feeder, and a container for receiving the tablets or the divided tablets.

BACKGROUND ART

According to a pharmaceutical feeding apparatus of a related art, tablet feeders provided in multiple steps in the entire circumference thereof with rotors are installed in a tablet receiving case, and tablets are selectively fed from the tablet feeders and wrapped based on the prescription (see, FIG. 1 of Patent document 1 and FIG. 38 of the present invention), or the tablet feeders are arranged in the form of a tray to selectively feed the tablets based on the prescription (see, FIG. 6 of Patent document 2 and FIG. 36 of the present invention).

In the tablet feeder, a rotor is installed in a container receiving a plurality of tablets, and a plurality of recesses are formed along an entire lateral side of the rotor at a regular interval to receive the tablets. As the rotor rotates, the tablets provided in the container are received in the recesses such that the tablets may move in the rotating direction of the rotor. When the recesses face a discharge port, the tablets are discharged from the recesses one by one through the discharge port (see, patent document 3).

Meanwhile, one dose of half-size tablets may be prepared according to the prescription. In this case, the half-size tablets are previously set in the tablet feeder to allow the tablet feeder to feed the half-size tablets.

A tablet divider divides the tablets into half-size tablets by using a rotary cutter while the tables are moved downward with being pinched between a pair of belt conveyers, (see, FIG. 1 of patent document 4). In addition, the tablets being moved into a tube are blocked by a shutter and a cutter of a tablet divider divides the tablet into half-size tablets in such a manner that a lower half-size tablet is dropped down and an upper half-size tablet is kept on the cutter and then dropped down as the cutter moves to its initial position (see, FIG. 6 of patent document 5).

Patent document 1: Japanese Patent Unexamined Publication No. 2003-63503.

Patent document 2: Japanese Patent Unexamined Publication No. 2008-162609.

Patent document 3: Japanese Patent Unexamined Publication No. 2005-59903.

Patent document 4: Japanese Patent Unexamined Publication No. 1990-29257.

Patent document 5: Japanese Patent Unexamined Publication No. 1999-226089.

Patent document 6: Japanese Patent Unexamined Publication No. 2005-272011.

Patent document 7: Japanese Patent Unexamined Publication No. 2007-75178.

DISCLOSURE

Technical Problem

The former tablet divider divides the tablet in the longitudinal direction so the tablet is divided into a left half-size tablet and a right half-size tablet and the left and right half-size tablets are simultaneously dropped down. For this reason, a user must manually sort the half-size tablets. In addition, when odd half-size tablets are prepared according to the prescription, one half-size tablet may unnecessarily remain, so a user must remove one half-size tablet by using a hand.

Meanwhile, the latter tablet divider can drop the upper and lower half-size tablets one by one, so the upper half-size tablet may be kept on the cutter without being dropped down until next feeding. That is, it is not necessary to remove the remaining one half-size tablet, so the inconvenience occurring in the former tablet divider may not happen.

However, since the cutter is moved, the operation of the latter tablet divider may be complicated.

In addition, when the latter tablet divider is assembled with a tablet division packaging device having a plurality of tablet feeders, the latter tablet divider is installed separately from the tablet feeders (see, FIG. 1 of patent document 5), or installed in a space where at least two tablet feeders are removed (see, FIG. 7 of patent document 5).

If it is impossible to exchange the existing tablet feeder without exchanging a mounting table for the tablet feeder and so on, the size of the pharmaceutical feeder may be enlarged and the manufacturing cost may increase.

In addition, since there is no sensor for detecting the half-size tablet placed on the cutter, when the tablet feeder is disassembled (in general, a tablet cassette is disassembled from a mounting table; see, the embodiments described later) and then set again under the specific circumstance, it is impossible to check the half-size tablet even if the half-size tablet is removed.

Meanwhile, since a rotating shaft of a rotor of a conventional tablet feeder is supported by a radial bearing, the axis of the rotating shaft may be fluctuated, so that the rotor cannot be smoothly rotated. In addition, the rotational force of the rotating shaft is transferred through a motor to a gear mechanism. However, since small-sized gears are engaged with each other in the gear mechanism, the rotor may be fluctuated due to the backlash so that the rotor may not smoothly rotate (see, FIGS. 1 and 2 of patent document 3).

Further, in the conventional tablet feeder, when the tablet supplied to the discharge port passes through a path for a packaging process and so on, the passing of the tablet may not be detected by a sensor installed in the path, so that it is impossible to detect whether the tablet remains in the recess after the tablet has been supplied. In addition, since whether the tablets are supplied based on the prescription can be recognized by counting the number of passed tablets, the rotational angle of the rotor is estimated based on the rotational angle of the motor, but the detection for the actual rotational angle of the rotor (that is, the number of the recesses facing the discharge port) is not performed. Further, even when a fragment of the tablet, other than the regular tablet, passes through the path, the fragment is counted as the tablet, so the number of the tablets calculated based on the supply signal may be different from the number of tablets detected by the sensor. In particular, since the fragment of the tablet may be easily generated when the tablet is divided into the half-size tablets, the above defect may frequently occur.

In addition, tablet fragment may adhere to the half-size tablets divided by the tablet divider. According to the related art, the tablets are simply supplied to the container, so the tablet fragment is accumulated in the container. For this reason, the tablet fragment may be packaged together with the tablets during the division and packaging process and so on, so the tablet fragment may be delivered to patients.

The present invention has been made to solve the above problems occurring in the prior art, and a first object of the present invention is to provide a method of dividing a tablet, a tablet division feeder and a pharmaceutical feeding (charging) apparatus, in which the tablet can be divided without moving a cutter (cutting blade) and the divided tablets can be fed one by one. A second object of the present invention is to assemble the tablet feeder with a conventional pharmaceutical feeding (charging) apparatus having a plurality of tablet feeders without exchanging a mounting table for the tablet feeder and so on. A third object of the present invention is to detect whether a tablet, such as a half-size tablet, is kept on a cutter. A fourth object of the present invention is to smoothly rotate a tablet feeding rotor (removal of the backlash). A fifth object of the present invention is to detect an actual rotational angle of a rotor (the position of the rotor). A sixth object of the present invention is to prevent tablet fragment from sticking to the tablet. A seventh object of the present invention is to precisely count the number of supplied tablets.

Technical Solution

To accomplish the first object, according to the present invention, a tablet is moved in the horizontal direction and a fixing blade is positioned in a movement path of the tablet in such a manner that the tablet can be divided by the fixing blade while the tablet is moving. As the tablet is divided into upper and lower half-size tablets, the lower half-size tablet is discharged and the upper half-size tablet is transferred to and kept on a support plate extending from the fixing blade from a top surface of the fixing blade. As the upper half-size tablet further moves, the upper half-size tablet is discharged from the support plate.

In this manner, the tablet is divided while the tablet is moving, so that one half-size tablet located below the fixing blade may be dropped down and fed due to the self-weight thereof, and the other half-size tablet located above the fixing blade is kept on the fixing blade. If the half-size tablet kept on the fixing blade further moves, the half-size tablet is dropped down and fed due to the self-weight thereof.

At this time, the former operation of dividing the tablet and feeding the lower half-size tablet, and the latter operation of feeding the upper half-size tablet can be continuously or intermittently performed. The former and latter operations can be continuously performed based on the number of required tablets. For instance, when even tablets are required, the shift between the operations is stopped as the upper half-size tablet is supplied from the support plate. In addition, when odd tablets are required, the shift between the operations is stopped as the upper half-size tablet is kept on the support plate after the lower half-size tablet has been supplied.

In addition, in the case that the former and latter operations are intermittently performed, the division of the tablet and the feeding of the lower half-size tablet and the feeding of the upper half-size tablet are performed through at least one intermittent shift, for instance, two intermittent shifts, and the division of the tablet and the feeding of the lower half-size tablet and the feeding of the upper half-size tablet can be performed while the intermittent shift is being performed. A pause time for the intermittent shift must be set between the former operation of dividing the tablet and feeding the lower half-size tablet and the latter operation of feeding the upper half-size tablet. During the pause time, the former operation is completed, so the upper half-size tablet is kept on the support plate.

The tablet can be moved by a rotor, which will be described later, or a movable member performing the reciprocating movement. If the tablet is moved by the rotor, the division of the tablet and the discharge (feeding) of the lower half-size tablet and the discharge of the upper half-size tablet can be sequentially performed through the continuous (intermittent) rotation of the rotor. If the tablet is moved by the movable member, the movable member moves in one direction until the upper half-size tablet is supplied from the support plate to divide the tablet and to discharge the lower half-size tablet and then to discharge the upper half-size tablet. After that, the movable member moves back (returns) and then moves again in one direction, repeatedly.

The bottom surface of the recess is concaved in a circular arc shape when viewed from the top. In this case, since pharmaceuticals (tablets) have spherical shapes or disc shapes, the pharmaceuticals can be precisely fitted in the recess, so that the pharmaceuticals can be stably moved and divided. In detail, the sectional shape of the recess matches with the surface shape of the pharmaceuticals when viewed from the top.

In addition, the recess may be divided into a lower bottom portion and an upper bottom portion about a peripheral groove of the rotor for the fixing blade, in which the lower bottom portion is located lower (deeper) than the upper bottom portion and can be prepared as an inclined surface gradually directed forward in the downward direction (C-cut).

A burr may be inserted into an end of the peripheral groove for the fixing blade after the tablet has been divided. In this case, the lower half-size tablet may not be dropped down. However, if the recess has the C-cut configuration, the burr is introduced into the lower bottom portion of the recess so that the burr may be rarely inserted into the end of the peripheral groove for the fixing blade, so the above problem can be solved.

An end portion of the lower bottom portion of the recess is a depth surface having a surface level identical to a surface level of the upper bottom portion of the recess. Since the tablet (the lower half-size tablet) is introduced into the end portion of the lower bottom portion of the recess, the tablet received in the recess can be stabilized so that the tablet can be stably divided. The longitudinal length of the end portion of the lower bottom portion of the recess may be property determined through experiment by taking the stability of the tablet and the removal of the burr into consideration.

The fixing blade may have various shapes and thicknesses to the extent that the fixing blade can divide the tablet without causing the problem. Preferably, the fixing blade includes a thin blade, such as a razor blade. In addition, a laser can be used to divide the tablet. That is, the fixing blade may include a laser blade.

In addition, a tip of a flake-shape fixing blade, such as a razor blade, gradually protrudes toward the rotor in the movement direction of the tablet in such a manner that the tip of the flake-shape fixing blade can be gradually inserted into the tablet (see, FIG. 13(*a*) to FIG. 13(*c*)). If the tip of the flake-shape fixing blade is gradually inserted into the tablet, the tablet can be smoothly divided. Preferably, the tip of the flake-shape fixing blade is concaved in an arc shape in the rotating direction of the tablet (see, FIG. 13(*a*) to FIG. 13(*c*)).

A tablet division feeder performing the division and feeding of the tablet may include a moving unit to move a tablet, a fixing blade located in a movement path of the tablet, and a support plate extending from the fixing blade such that a half-size tablet is transferred from the fixing blade onto the support plate. The fixing blade divides the tablet into upper and lower half-size tablets as the tablet is moved in such a manner that the lower half-size tablet is discharged and the upper half-size tablet is transferred to and kept on the support plate, and the upper half-size tablet is discharged from the support plate as the upper half-size table is further moved.

In such a structure, the moving unit may include a rotor, which is installed in a container for receiving a plurality of tablets such that a rotating shaft of the rotor is longitudinally arranged in the container, a peripheral groove is formed along an entire lateral side of the rotor such that the fixing blade and the support plate are inserted into the peripheral groove, a rotor receiving part has a barrel shape with a bottom section formed with a tablet discharge port, the fixing blade and the support plate are installed outside the rotor receiving part, the fixing blade divides the tablet, which is accommodated in the recess and moves while being guided along an inner wall of the rotor receiving part as the rotor rotates, in such a manner that the lower half-size tablet is discharged through the discharge port and the upper half-size tablet is transferred from a top surface of the fixing blade onto the support plate extending from the fixing blade so as to be kept on the support plate, and the upper half-size tablet is discharged from the support plate to the discharge port as the rotor is further rotated.

The above structure can be achieved by simply adding a tablet divider, such as the fixing blade, to a tablet feeder according to the related art, so the existing mounting table can be used if the size of the tablet divider is set within the size of the tablet feeder (tablet cassette) according to the related art. That is, the second object can be accomplished.

When the tablet is divided by the fixing blade, if a lower guide is installed to arrange the tablet at the desired position of the fixing blade, for instance, at the longitudinal center of the fixing blade, the tablet can be divided into a desired size. If a spring member is used as the lower guide, the eating clearance of the fixing blade with respect to the tablet can be compensated due to the elasticity (flexure) of the lower guide, and the tablet can make pressure contact with the fixing blade due to the repulsive force of the spring, so that the tablet can be smoothly divided without destroying the tablet.

In addition, when the tablet is divided by the fixing blade, if the existing brush for partitioning the tablet is installed such that the tablet is pressed from the top to the bottom against the fixing blade, the brush can compensate for the eating clearance of the fixing blade in the upward direction with respect to the tablet while securely pressing the tablet against the fixing blade, so that the tablet can be smoothly divided. In addition, the upper half-size tablet can be prevented from spring out of the recess when the tablet is divided by the fixing blade, so that the upper half-size tablet can be stably placed on the support plate.

The brush has elasticity to press down the tablet when the tablet is divided by the fixing blade, so the eating clearance of the fixing blade with respect to the tablet can be compensated due to the elasticity of the brush. Thus, if the lower guide has no compensation function for the eating clearance of the fixing blade, the brush may serve as a guide plate having the compensation function for the eating clearance of the fixing blade. The compensation function for the eating clearance of the fixing blade may be achieved by one of the lower guide and the upper guide plate. In other words, it is sufficient to provide only one of the lower guide and the upper guide plate to compensate for the eating clearance of the fixing blade.

If a partition member is prepared as a brush having a plurality of elastic bristles arranged in parallel to each other, a protruding strip is installed on a bottom surface of the elastic bristles (bristles of the brush) aligned after the support plate in the rotating direction of the rotor such that the protruding strip can push the upper half-size tablet located away from the support plate. In this case, the upper half-size tablet can be precisely supplied in the downward direction.

It is not necessary to install the protruding strip for all elastic bristles. It is sufficient to install the protruding strip for the elastic bristles arranged after the front end of the fixing blade. The coverage of the protruding strip can be variously selected to the extent that the upper half-size tablet can be smoothly supplied.

In addition, the above structure, in which the protruding strip is installed on the bottom surface of the elastic bristles of the partition member, can be applied to the tablet feeder that feeds the tablet one by one as well as the tablet division feeder.

The support plate can be formed separately from or integrally with the fixing blade (double as the fixing blade, see, embodiments).

In addition, the attachment position of the fixing blade and the partition member (brush for partitioning the tablet) in the longitudinal direction can be adjusted by interposing a spacer between support portions of the fixing blade and the partition member. In this case, the division position of the tablet can be properly adjusted even when the division position of the tablet is changed caused by the variation of the size and shape of the tablet.

A knocking plate (division plate for half-size tablets) is disposed between the partition member including the brush and the spacer and/or between the fixing blade and the spacer in such a manner that a knocking part (division part) of the knocking plate is directed downward from the front end of the fixing blade and (or) the partition member or protrudes forward. In this case, the knocking part of the upper plate pushes (knocks) the upper half-size tablet remote from the front end of the fixing blade (support plate), so that the upper half-size tablet can be accurately dropped to the discharge port. In addition, the division part of the lower plate may accurately divide the upper and lower half-size tablets, which are divided by the fixing blade, in such a manner that the lower half-size tablet can be dropped in the downward direction (the discharge port) of the recess. The above operation is effective when the pharmaceutical (tablet) has viscosity, such as a sugar-coated tablet. The coating material of the sugar-coated tablet may remain as a fiber, so a fiber member may be blocked by an inner end of the recess, thereby interrupting the drop of the tablet. If the division part also is directed downward, the division part may perform the knocking operation. The position of the knocking part and the division part may be properly determined through experiment to the extent that the above operation can be achieved.

In addition, at least one of the plates, the protruding strips of the elastic bristles and C-cut of the recess may be selectively employed.

A tablet detecting sensor can be installed to detect whether the upper half-size tablet is placed on the support plate after the tablet has been divided into upper and lower half-size tablets. When it is necessary to supply odd tablets, if the tablet feeder is separated from the mounting table in a state that the tablet is placed on the support plate and then the tablet is removed due to the specific circumstance, the tablet detecting sensor detects the removal of the tablet when the tablet feeder is reset, so the tablet can be fed by taking the above situation into consideration at the next feeding. That is, the feeding of the tablet may not be performed if it is determined that the upper half-size tablet is placed on the support plate.

The third object of the present invention can be accomplished through the above structure.

For instance, the tablet detecting sensor includes an actuator (arm) installed at an attachment block with respect to the rotor receiving section of the fixing blade, and a sensor to detect a fluctuation of the actuator. The actuator includes a wiper positioned at the head point of the fluctuation and located in the movement path of the tablet received in the recess of the rotor. The tablet makes contact with the wiper as the tablet is moved so that the tablet exerts an action on the actuator, and the sensor detects the tablet according to the action of the arm.

The rotor is formed on the entire lateral side thereof with a peripheral groove into which the wiper is inserted. If the wiper inserted into the peripheral groove is located in the movement path of the tablet, the tablet (half-size tablet) makes contact with the wiper to press the wiper as the tablet received in the recess moves so that the detection accuracy may be improved. In this case, the actuator is pressed by the action exerted on the actuator, so that the actuator is fluctuated.

The tablet detecting sensor having the above structure can be applied to the tablet feeder according to the related art, which feeds the tablet through the rotation of the rotor without dividing the tablet. For instance, the tablet detecting sensor can be applied to the tablet feeder A, in which a rotor is installed in a container for receiving a plurality of tablets such that a rotating shaft of the rotor is longitudinally arranged in the container, recesses are formed in an axial direction of the rotor along an entire lateral side of the rotor at a regular interval to receive the tablets, a rotor receiving part of the container has a tablet discharge port, and the tablets, which are accommodated in the recesses and move while being guided along an inner wall of the rotor receiving part, are sequentially discharged through the discharge port as the rotor rotates.

In addition, a motor is installed in a mounting table for the container, a pinion rotated by the motor is installed at an edge of a mounting surface of the mounting table for the container, a rotating shaft of the rotor protrudes through the bottom surface of the container, a large-size gear to be engaged with the pinion is installed at an end of the rotating shaft of the rotor, and the pinion is engaged with the large-size gear as the container is mounted on the mounting table. In this case, the rotor is rotated according to a number of rotations (high RPM) of the pinion, so the malfunction caused by the backlash between the pinion and the large-size gear can be reduced. Thus, the rotor can be precisely and smoothly rotated. This is because the pinion is installed at the edge of the mounting surface of the mounting table for the container so that the large-size gear can be installed at the rotating shaft of the rotor. If the pinion is provided at the center of the mounting surface, the rotating shaft is positioned at the center of the mounting surface, so it is difficult to attach the large-size gear in the vicinity of the center of the mounting surface.

Similarly, the engagement structure between the pinion and the large-size gear can be employed not only in the tablet division feeder, but also in the tablet feeder A according to the related art, which sequentially feeds the tablets received in the recesses through the rotation of the rotor without dividing the tablets.

In addition, the rotating shaft of the rotor is rotatably supported by a bearing unit provided at the bottom of the container. The bearing unit includes a pair of upper and lower thrust bearings to support the rotating shaft of the rotor. Since the rotating shaft of the rotor can be rotated without fluctuation, the rotor may precisely and smoothly rotate.

Since the pinion is engaged with the large-size gear and the rotating shaft of the rotor is supported by a pair of upper and lower thrust bearings, the rotor can be smoothly rotated, so that the fourth object of the present invention can be accomplished. The engagement structure and the support structure can be compatibly employed and also can be applied to the tablet feeder A according to the related art, which sequentially feeds the tablets received in the recesses through the rotation of the rotor without dividing the tablets, as well as the tablet division feeder.

In addition, in the case in which a disc is concentrically and integrally fixed with the rotating shaft, a plurality of concavo-convex sections are formed at a regular interval along a peripheral portion of the disc corresponding to the recesses of the rotor, and the rotating angle (position of the recesses) of the rotor is detected by detecting the concavo-convex sections, it is possible to detect the actual rotating position of the rotor. Thus, when the rotor is not rotated although the motor is driven to rotate the rotor, it can be detected. In particular, when the tablet is divided, it is possible to precisely detect whether the half-size tablets are supplied based on the rotation of the rotor. The concavo-convex sections can be formed on the lateral side, the top surface or the bottom surface of the disc.

Further, if the concavo-convex sections of the disc are aligned corresponding to the recesses of the rotor, the supply time of the lower and upper half-size tablets can be precisely detected after the tablet has been divided into the lower and upper half-size tablets. In addition, by comparing the signal to detect the concavo-convex section of the disc with the detecting signal of the tablet detecting sensor, the relation between the supply operation and the tablet facing the discharge port can be recognized. For instance, if the tablet facing the discharge port disappears due to the specific circumstance although the concavo-convex section detecting signal represents that the supply operation for the tablet is not performed, the disappearance of the tablet can be detected (see, the embodiments for details).

The fifth object of the present invention can be accomplished by detecting the concavo-convex sections. Also, the concavo-convex sections can be applied to the tablet feeder A according to the related art, which sequentially feeds the tablets received in the recesses through the rotation of the rotor without dividing the tablets, as well as the tablet division feeder.

In particular, the half-size tablets discharged through the discharge port are temporally stored in the receptacle before they are transferred to the package process or the half-size tablets are stored in the receptacle to selectively use the half-size tablets for prescription. In this case, if a porous plate formed with a plurality of pores having a size smaller than the size of the half-size tablet to prevent the half-size tablets from passing through the porous plate is detachably installed at the middle of the receptacle, the tablet fragment can be dropped down through the porous plate so that the tablet fragment may not adhere to the half-size tablets placed on the porous plate.

The sixth object of the present invention can be accomplished through the receptacle structure and the receptacle structure can be applied to the tablet feeder A according to the related art, which sequentially feeds the tablets received in the recesses through the rotation of the rotor without dividing the tablets, as well as the tablet division feeder. In this case, the table fragment generated by the friction among the tablets can be removed.

A fragment removal device may include a porous plate formed with a plurality of pores having a size smaller than a size of the half-size tablet to prevent the half-size tablets from passing through the porous plate. The porous plate is arranged while crossing a tablet path extending from the tablet discharge port of the tablet feeder installed on the cassette mounting table. If the porous plate has a stair structure extending downward in a zigzag manner, a path for removing the tablet fragment may be lengthened in a narrow space. The porous plate may be replaced with various plates, such as a fragment removal plate formed with slits having a width sufficient to block the tablets. In addition, the fragment removal device installed in the tablet path can be employed not only in the tablet division feeder, but also in the tablet feeder A according to the related art, which sequentially feeds the tablets received in the recesses through the rotation of the rotor without dividing the tablets.

According to the tablet counting method (apparatus) in the tablet feeding apparatus (tablet feeder), which supplies the tablets (half-size tablets) in the predetermined period of time based on the tablet supply signal by using the tablet division feeder or the tablet feeder having the above structure, the tablet passing through the tablet path is detected by the sensor installed in the tablet path and detected signals are counted in the predetermined period of time. At this time, signals detected out of the predetermined period of time are omitted from counting, so only the tablets can be counted, and the counting accuracy can be improved. In this manner, the seventh object of the present invention can be accomplished.

When counting the signals, if the type of objects passing through the tablet path is detectable based on the shape or the size of the tablets, it is possible to count only the tablets (half-size tablets) regardless of the pass timing. If the sensor can detect the type of objects passing through the tablet path, the sensor may not count the objects when the sensor recognized the objects other than the tablets, such as fragments, so that the seventh object of the present invention can be accomplished. According to the above counting method (apparatus), the tablets can be detected regardless of the pass timing, so that the tablets can be counted regardless of the supply timing of the rotor. Thus, the number of tablets can be precisely counted even if the tablets are supplied at the high speed (high-speed rotation of the rotor).

As described above, the above counting method (apparatus) can be employed not only in the tablet division feeder, but also in the tablet feeder A according to the related art, which sequentially feeds the tablets received in the recesses through the rotation of the rotor without dividing the tablets. In addition, the above counting method (apparatus) can be employed in the tablet feeder, which supplies the tablets using various devices.

Advantageous Effects

As described above, according to the present invention, the tablet is divided by the fixing blade while the tablet is moving, and the half-size tablets can be supplied one by one with time difference, so the half-size tablets can be properly counted and automatically supplied.

In addition, as described above, the half-size tablets can be individually supplied and the tablet feeder according to the related art can be exchanged with the tablet division feeder according to the present invention without exchanging the mounting table for the tablet feeder.

Further, since the half-size tablet kept on the cutter can be detected, the feeding number of the half-size tablets can be precisely counted.

In addition, the rotor can be smoothly rotated when feeding the tablets, and the actual rotational angle (the position of the rotor) of the rotor can be detected, so the existence of the half-size tablets can be recognized based on the position of the rotor. Thus, the error may not occur when counting the feeding number of half-size tablets even if the tablet feeder is disassembled or assembled in a state that the upper half-size tablet remains on the cutter.

Further, the tablet fragments generated when the tablet is divided may not adhere to the tablets or the half-size tablets.

In addition, the amount of the tablets supplied through the tablet division feeder can be precisely counted.

BEST MODE FOR INVENTION

Figure 36:
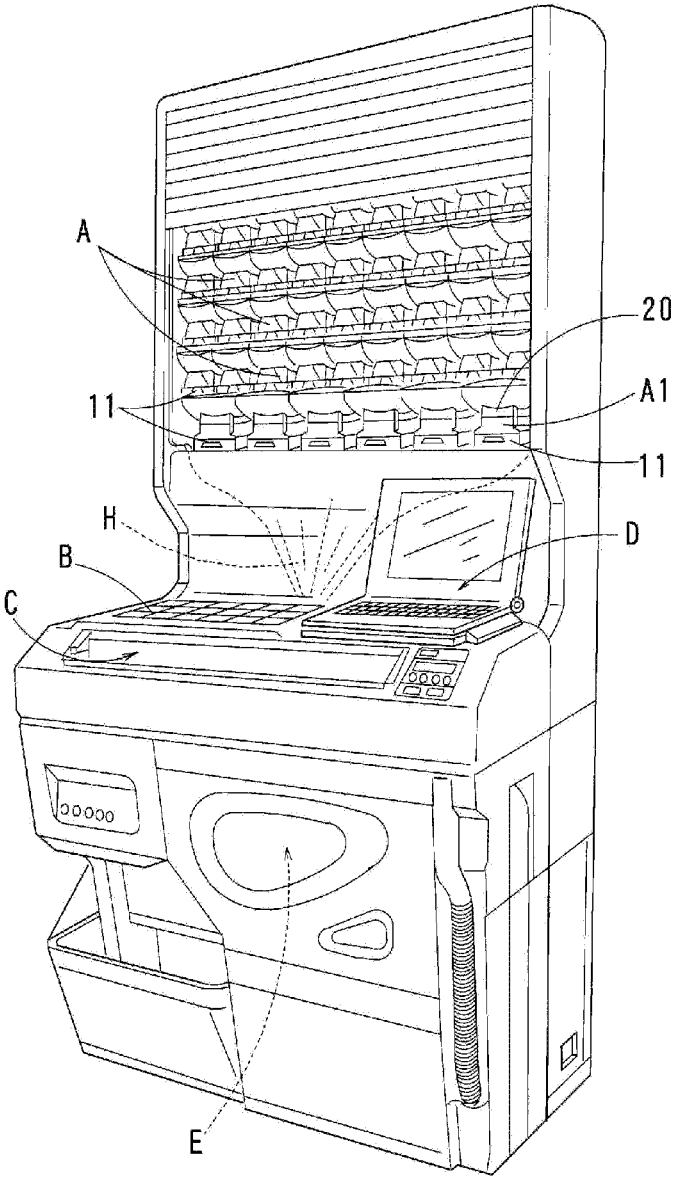
FIG. 36 is a perspective view showing an example of a pharmaceutical feeding apparatus.
Figure 37:
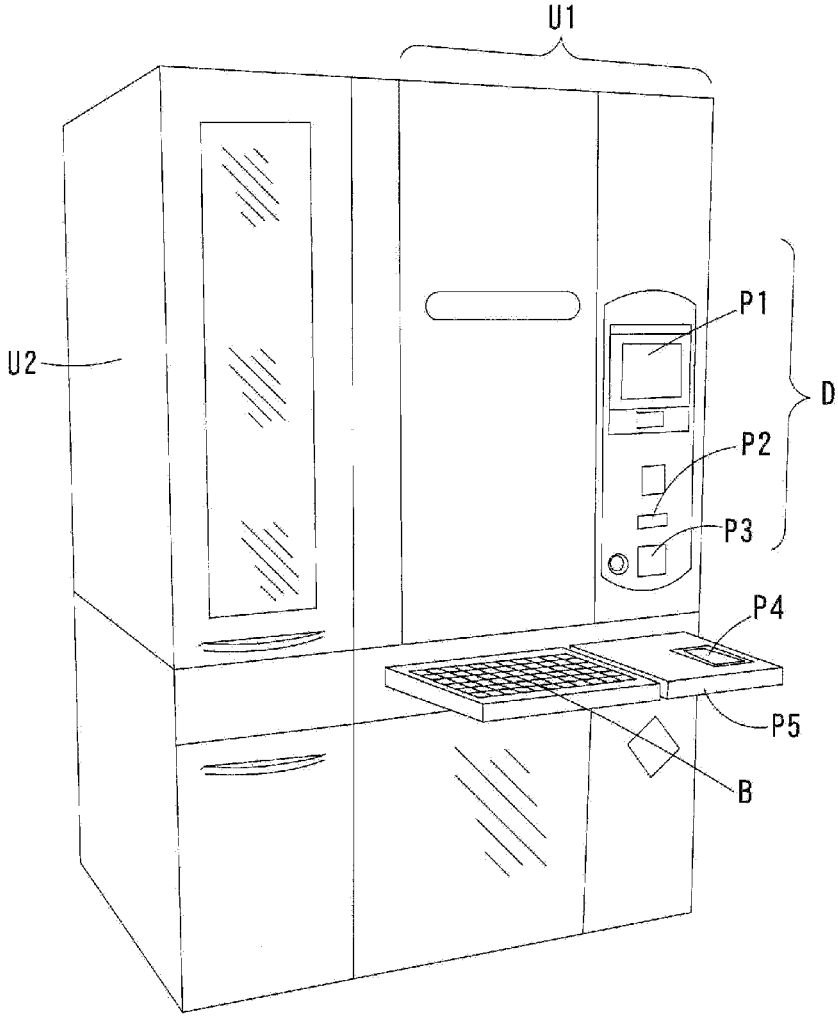
FIG. 37 is a perspective view showing another example of a pharmaceutical feeding apparatus.
Figure 38:
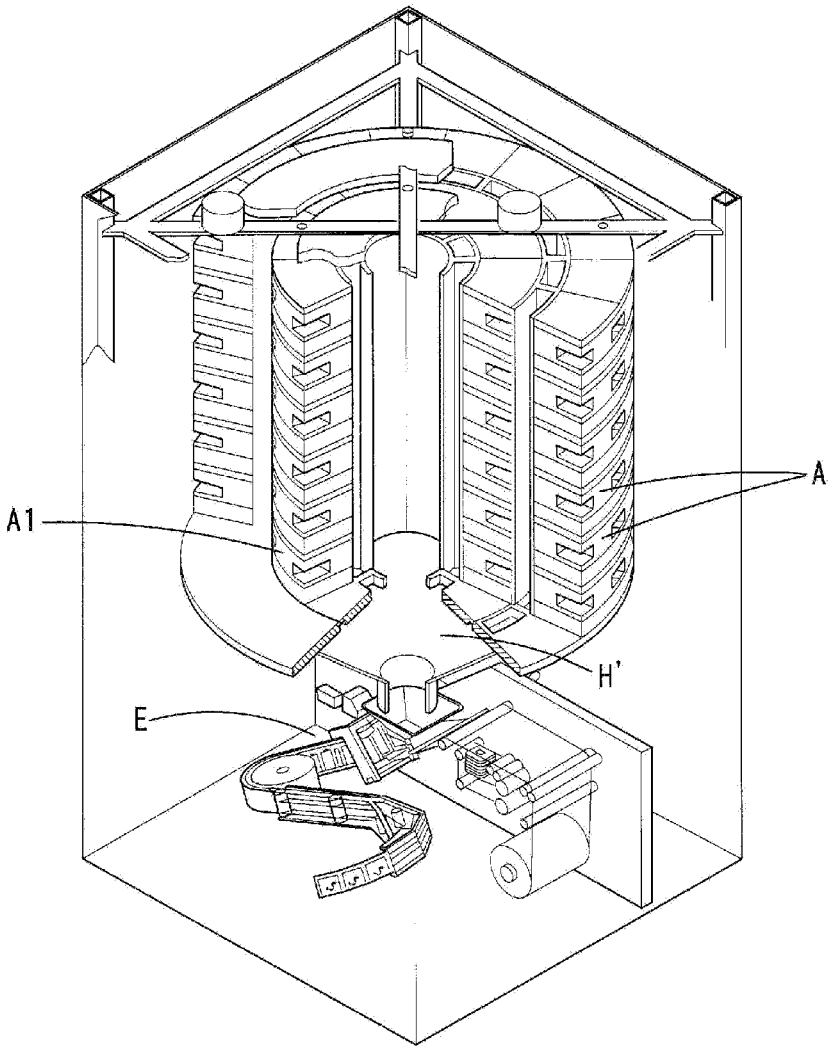
FIG. 38 is a partially-cut perspective view of FIG. 37.

The embodiments of the present invention can be applied to a pharmaceutical feeding apparatus shown in FIG. 36, in which a tablet feeder A is installed in the form of a tray, a pharmaceutical feeding apparatus shown in FIGS. 37 and 38, in which a tablet feeder A is installed in the form of a cylindrical tray, or a pharmaceutical charging apparatus for charging tablets T by supplying the tablets T into a vial container. One of the tablet feeders A is exchanged with a tablet division feeder A1 according to the present invention. Thus, the tablet feeder A and the tablet division feeder A1 may use the same motor base (mounting table 11).

Figure 1:
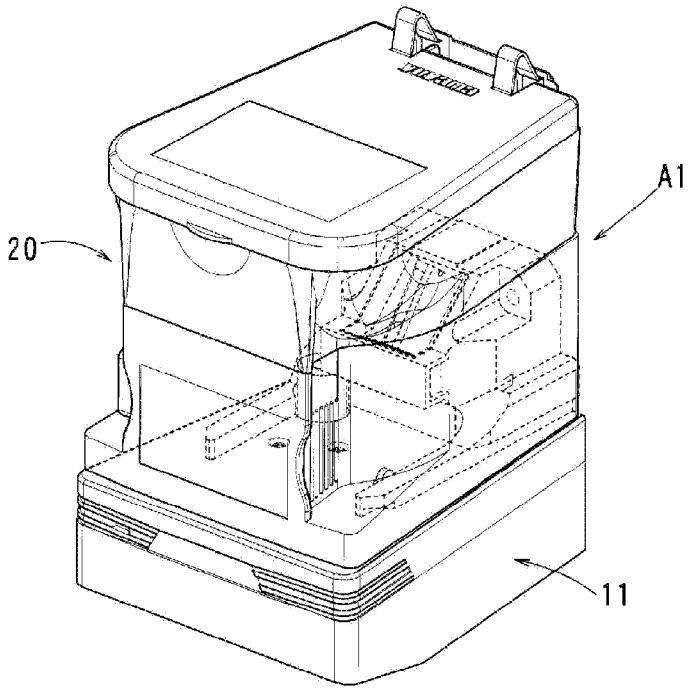
FIG. 1 is a perspective view showing a tablet feeder according to one embodiment of the present invention.
Figure 2:
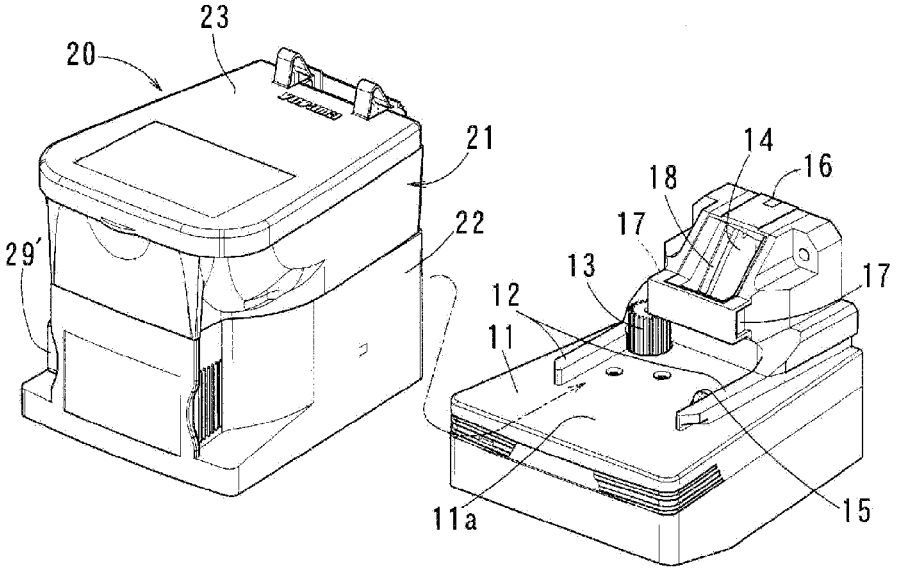
FIG. 2 is an exploded perspective view showing a tablet cassette and a mounting table for the tablet cassette according to one embodiment of the present invention.
Figure 3:
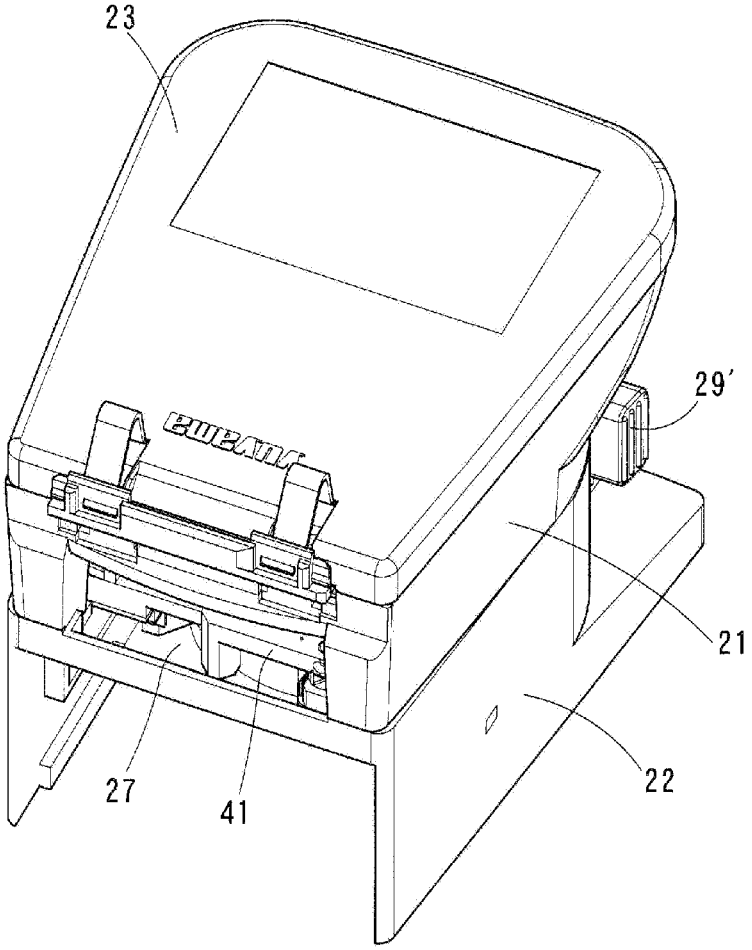
FIG. 3 is a bottom perspective view showing the tablet cassette according to one embodiment of the present invention.
Figure 4:
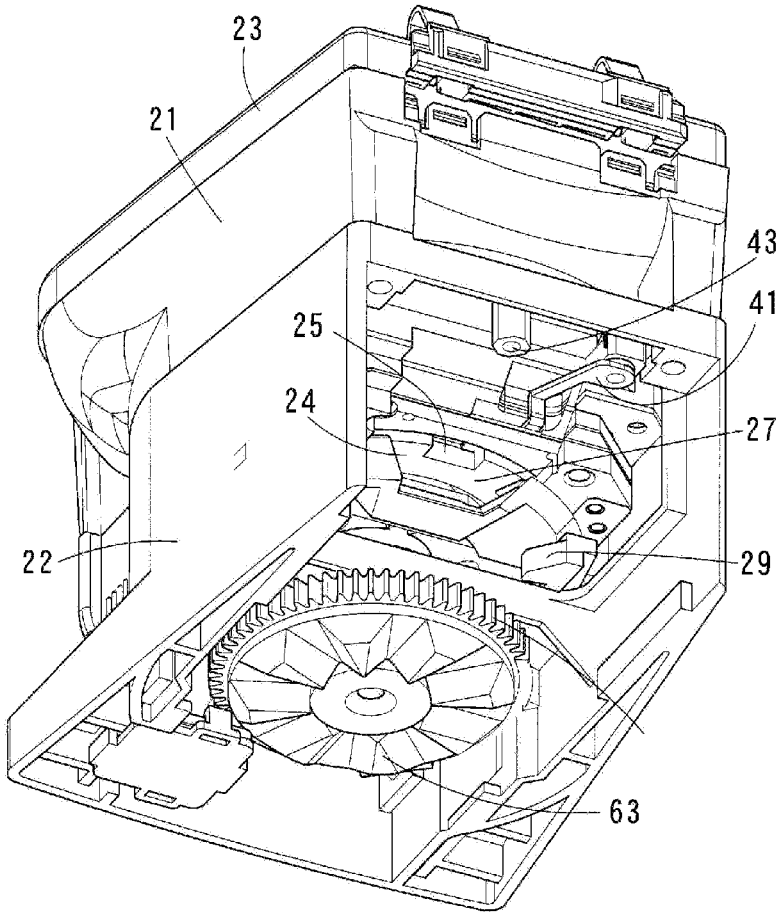
FIG. 4 is a rear perspective view showing a rear portion of the tablet cassette according to one embodiment of the present invention.

For instance, the pharmaceutical feeding (charging) apparatus may include a tablet feeder A receiving part, tablet receiving part B for a manual distribution, a V-shape receiving part C to distribute powdered medicines, a handling part D, a pharmaceutical packaging part E (for sorting and packaging pharmaceuticals), a container feeding unit Q, and a take-out unit K (see, FIG. 2 of patent document 6 and FIG. 1 of patent document 1).

According to the pharmaceutical feeding apparatus shown in FIG. 36, required tablets are supplied from the tablet feeder A receiving part to a tablet hopper (see, reference numeral 10 in FIG. 1 of patent document 2) through a tablet hopper H based on the prescription, and then the collected tablets are transferred to the pharmaceutical packaging part E through a group hopper (see, reference numeral 30 in FIG. 1 of patent document 2) to package the tablets. In the tablet receiving part B for a manual distribution, the tablets which are not present in the tablet cassette A, A1 receiving part, or the tablets T (half-size tablets T1 and T2) regardless of whether the tablets are present in the tablet cassette receiving part are transferred to the tablet hopper H, and then transferred to the pharmaceutical packaging part E to package the tablets. In addition, a predetermined amount of powdered medicines is input into the V-shape receiving part C to transfer the powdered medicines, by distributing the powdered medicines, to the group hopper and to the pharmaceutical packaging part E to package the powdered medicines (see, patent document 6).

In addition, the pharmaceutical (tablet) feeding apparatus of FIGS. 37 and 38 feeds only the tablets T. According to the pharmaceutical feeding apparatus shown in FIGS. 37 and 38, required tablets T (half-size tablets T1 and T2) are supplied from the tablet feeder A receiving part to a tablet hopper H' (see, reference numeral 10 in FIG. 1 of patent document 2) based on the prescription, and then transferred to the pharmaceutical packaging part E to package the tablets (see, patent document 1). Referring to FIG. 37, the apparatus shown in FIG. 38 is received in a right unit U1 and the tablet feeder A receiving part shown in FIG. 36 is received in a left unit U2 by miniaturizing the tablet feeder A receiving part. In FIG. 37, P1 is a control panel, P2 is a barcode reader, P3 is a journal printer, P4 is a reader writer of RFID, and P5 is a table for a tablet cassette 20, which will be described later.

Figure 39:
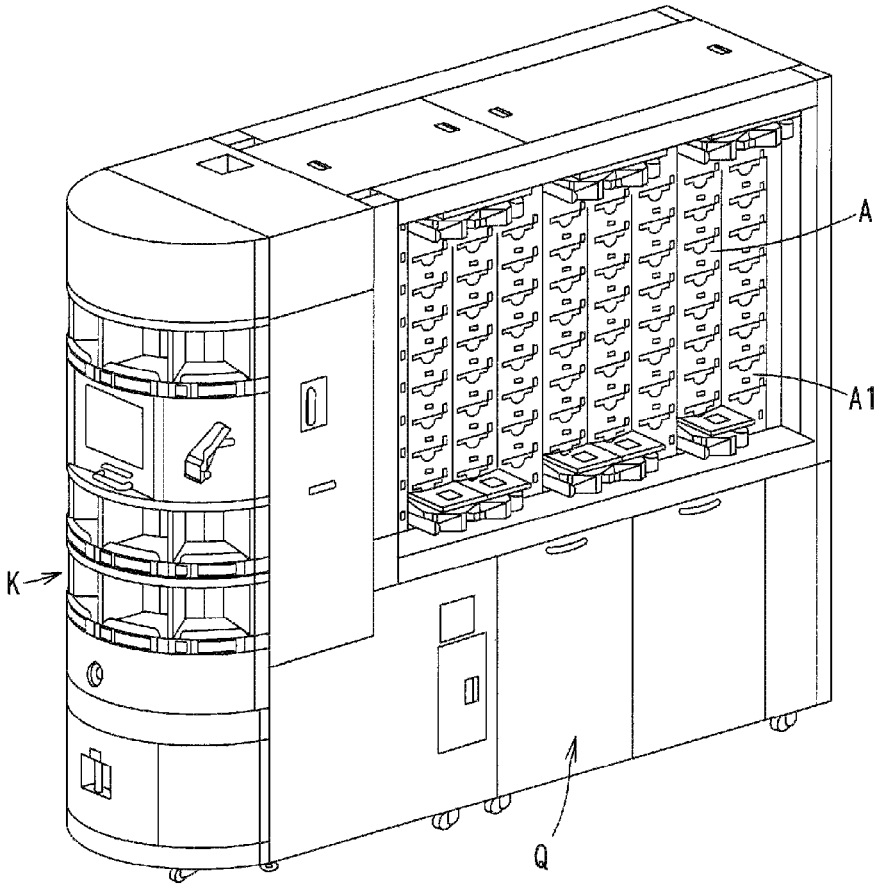
FIG. 39 is a perspective view showing an example of a pharmaceutical charging apparatus.

In addition, according to the tablet charging apparatus shown in FIG. 39, required tablets T (half-size tablets T1 and T2) are supplied from the tablet feeder A receiving part based on the prescription. At the same time, a vial bottle having a desired size is supplied and the tablets are filled in the vial bottle (see, patent document 7).

Such a tablet division feeder A1 (tablet feeder A) is shown in FIGS. 1 to 11. The motor base for the tablet division feeder A1 (tablet feeder A) is amounting table 11, which is made from synthetic resin, and a tablet cassette (container 20) of the tablet division feeder A1 is detachably mounted on the mounting table 11. As shown in FIGS. 36, 38 and 39, one end of the mounting table 11 is fixed to the body of the pharmaceutical feeding (charging) apparatus and installed at a part of the tray. A guide part 12 is installed on the top surface of the mounting table 11. A U-shape support part 22 of the tablet cassette 20 is guided along an inner wall of the guide part (see, FIGS. 1 to 4).

In addition, a motor (not shown), which is driven based on a control signal of a control unit (not shown), is mounted on the mounting table 11. A rotating shaft of the motor protrudes to an edge of a mounting surface 11*a* of the mounting table 11 and a pinion 13 is fixedly mounted on the rotating shaft of the motor.

Further, a second path 14 is formed in the mounting table 11. The second path 14 is communicated with a discharge port 27 of the tablet cassette 20 and inclined downward. A sensor 18 is installed in the second path 14 to detect the tablets T (half-size tablets T1 and T2) passing through the second path 14 along both sides thereof. The second path 14 is communicated with the hopper H of a pharmaceutical division packaging device (see, FIG. 1 and paragraph 0047 of patent document 3).

An actuator 15 of a micro-switch protrudes from the mounting surface 11*a* of the mounting table 11. The actuator 15 slidably makes contact with concavo-convex sections 65*a* and 65*b* of a disc 63 of the tablet division feeder A1, which will be described later. As the actuator 15 is fluctuated due to the concavo-convex sections, the micro-switch is turned on/off, thereby detecting the rotational angle (the position of the rotor 24) of the disc 63. In addition, a magnetic sensor 16 is installed on an upper wall of the second path 14 to detect a magnet 43 of a tablet detecting sensor 40 of the tablet division feeder A1 (see, FIG. 2), which will be described later.

Further, locking holes (claw 17) are formed at both sides of a front wall of the second path 14 and a pair of claw members 29 (see, FIGS. 4 and 5) provided on a bottom of the tablet cassette 20 are fixedly inserted into the locking holes 17. If the tablet cassette 20 is set on the mounting table 11, claws 29" are inserted into the locking holes 17, so that the tablet cassette 20 is integrated with the mounting table 11. If a protrusion (button 29') of the claw member 29, which protrudes in the lateral direction of the tablet cassette 20, is pressed, the claws 29" are released from the locking holes 17, so that the tablet cassette 20 can be separated from the mounting table 11.

Figure 33:
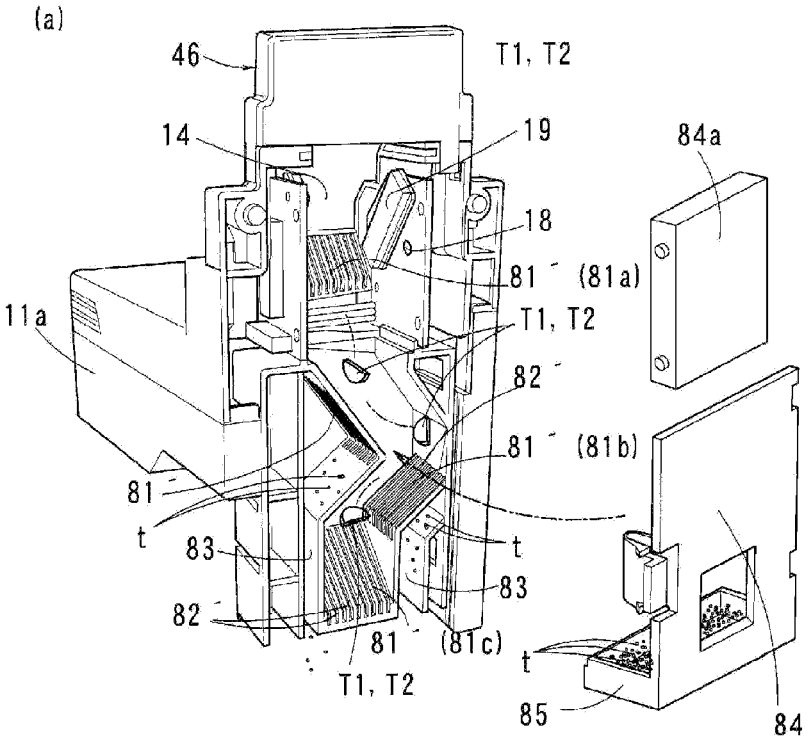
FIG. 33 is a view showing the motor base according to another embodiment of the present invention, in which (a) is a rear exploded perspective and (b) is a perspective view.
Figure 33:
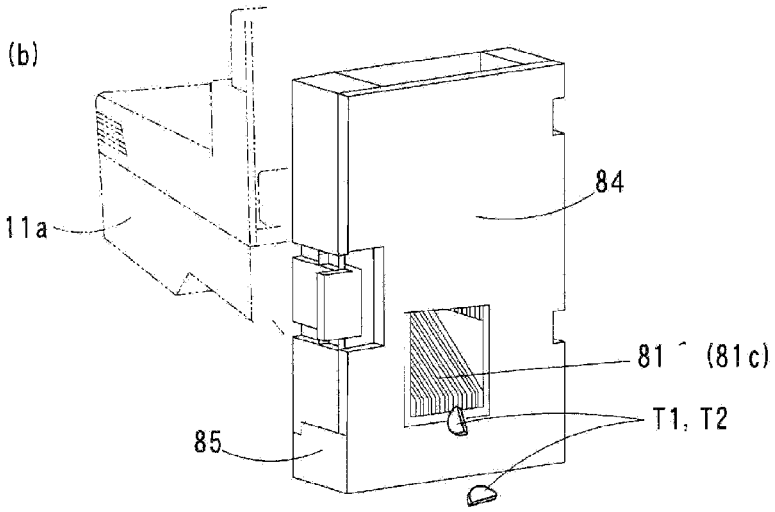

Meanwhile, a magnetic sensor (although not shown, it is installed at a rear of a fragment removal plate 81' shown in FIG. 33) is installed in the second path 14. The magnetic sensor can detect metal fragments passing through the second path 14 when the metal fragments are supplied together with the tablets due to the breakage of the fixing blade 33.

As shown in FIGS. 2 to 6, the tablet cassette 20 includes a container 21 made from a synthetic resin and the U-shape support part 22, when viewed from the top, made from a synthetic resin and integrally formed with the container 21. The container 21 includes a rectangular part 21*a*, a conical part 21*b* and a cylindrical part 21*c* having a bottom section, which are sequentially provided from the top of the container 21.

A plurality of tablets T are received in the container 21. An upper opening section of the rectangular part 21*a* is open/closed by a cover member 23.

The rotor 24 made from a synthetic resin is installed in the cylindrical part 21*c*. The rotor 24 has a conical top surface, and a plurality of pocket parts (recesses 25) extending in the axial direction are formed along an outer lateral side of the rotor 24 at a regular interval. According to the present embodiment, eight pocket parts 25 are provided. Each pocket part 25 has a width suitable for receiving only one tablet T. As the rotor 24 rotates, the tablets Tin the container 21 is introduced into the pocket parts 25 one by one while being overlapped one another in the longitudinal direction. Thus, first paths 26 (see, FIG. 9) are formed between each pocket part 25 and the inner peripheral surface of the cylindrical part 21*a*. According to the present embodiment, eight first paths 26 are formed. The discharge port 27 is formed at the lower portion (bottom plate of the cylindrical part 21*c*) of the container 21 (see, FIG. 9). The discharge port 27 has a size slightly larger than twice the width of one pocket part 25 of the rotor 24 (see, FIG. 12).

The rotating shaft 28 of the rotor 24 protrudes upward roughly from the center of the lower surface of the bottom wall (bottom plate of the cylindrical part 21*c*) of the container 21, and a large-size gear 61 is fixed to the rotating shaft 28. When the tablet cassette 20 is mounted on the mounting table 11, the large-size gear 61 is engaged with the pinion 13 and the rotor 24 is rotated (see, FIG. 4) as driving force of the motor is applied to the rotor 24 through the engagement (the large-size gear 61 and the pinion 13).

According to the present embodiment, the pinion 13 is located to the left in FIG. 2 and the rotor 24 is rotated clockwise when viewed from the top (see, FIG. 13), so the pinion 13 is rotated counterclockwise, thereby rotating the large-size gear 61 clockwise. Even when the dividing of the tablet T is interrupted due to specific reasons, and the rotation of the rotor 24 is blocked by the tablets T (half-size tablets T1 and T2) provided in the rotor 24 (pocket part 25), the pinion 13 may continuously apply the clockwise rotating force to the large-size gear 61. At this time, since the force direction of the large-size gear 61 matches with the mounting direction of the tablet cassette 20, the tablet cassette 20 may not be separated from the mounting table 11. According to the present embodiment, a tablet divider 30 is additionally provided, so there are problems in that the high-power motor is necessary and the tablet cassette 20 may be easily separated from the mounting plate 11. However, since the pinion 13 is located to the left, the above problems may be attenuated.

In addition, in the case that the tablet T is divided by rotating the rotor 24 counterclockwise, the pinion 13 is installed to the right end. If the mounting direction of the tablet cassette 20 is different from the above, the pinion 13 is located in opposition to the above. That is, the position of the pinion 13 can be properly selected such that the mounting direction of the tablet cassette 20 matches with the force direction of the large-size gear 61. In addition, when the clogging occurs due to the tablets T, T1 and T2 stagnated in the pocket parts 25 and so on, the increased load of the motor is detected and the rotor 24 is rotated in the reverse direction to solve the clogging.

Figure 5:
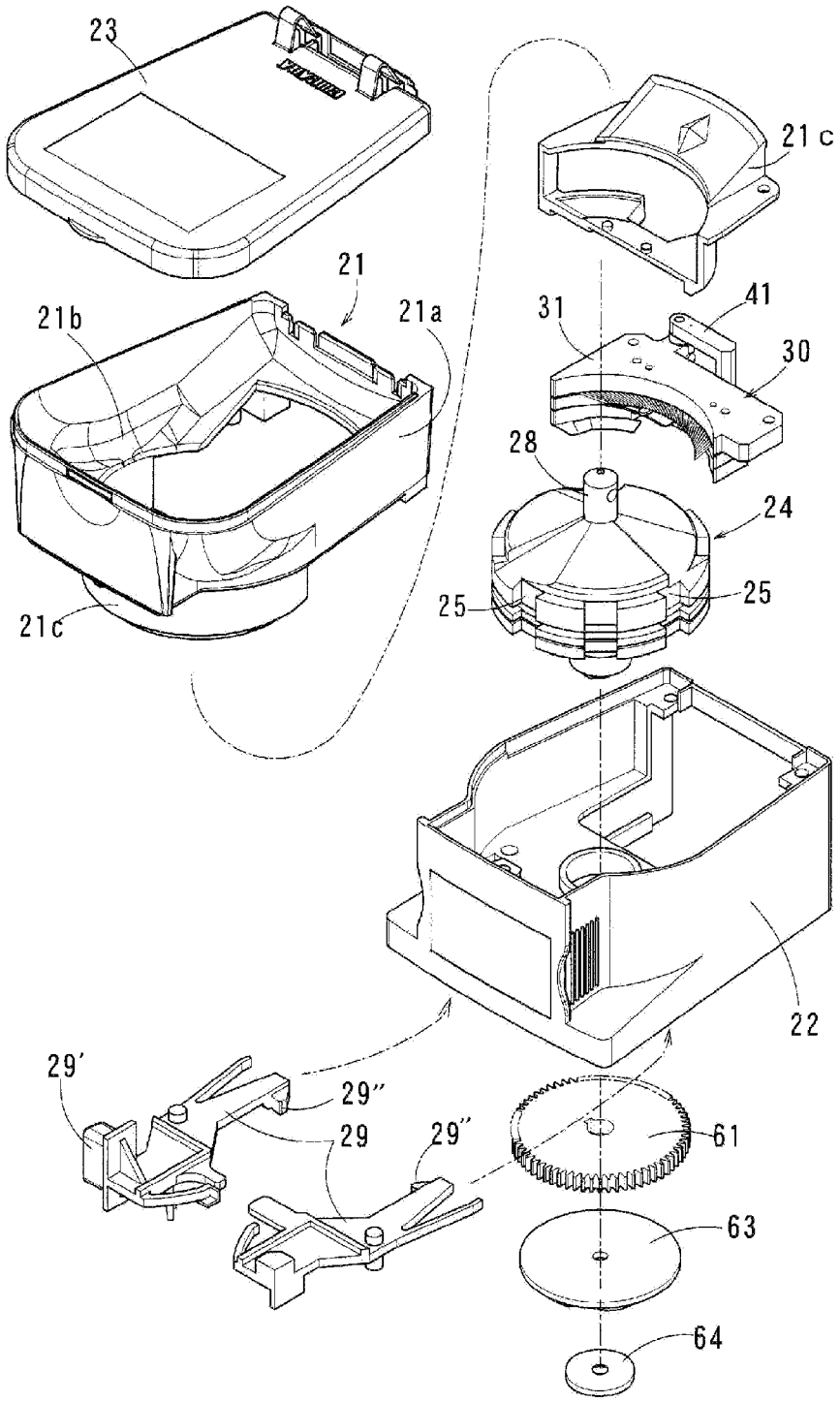
FIG. 5 is an exploded perspective view showing the tablet cassette according to one embodiment of the present invention.
Figure 6:
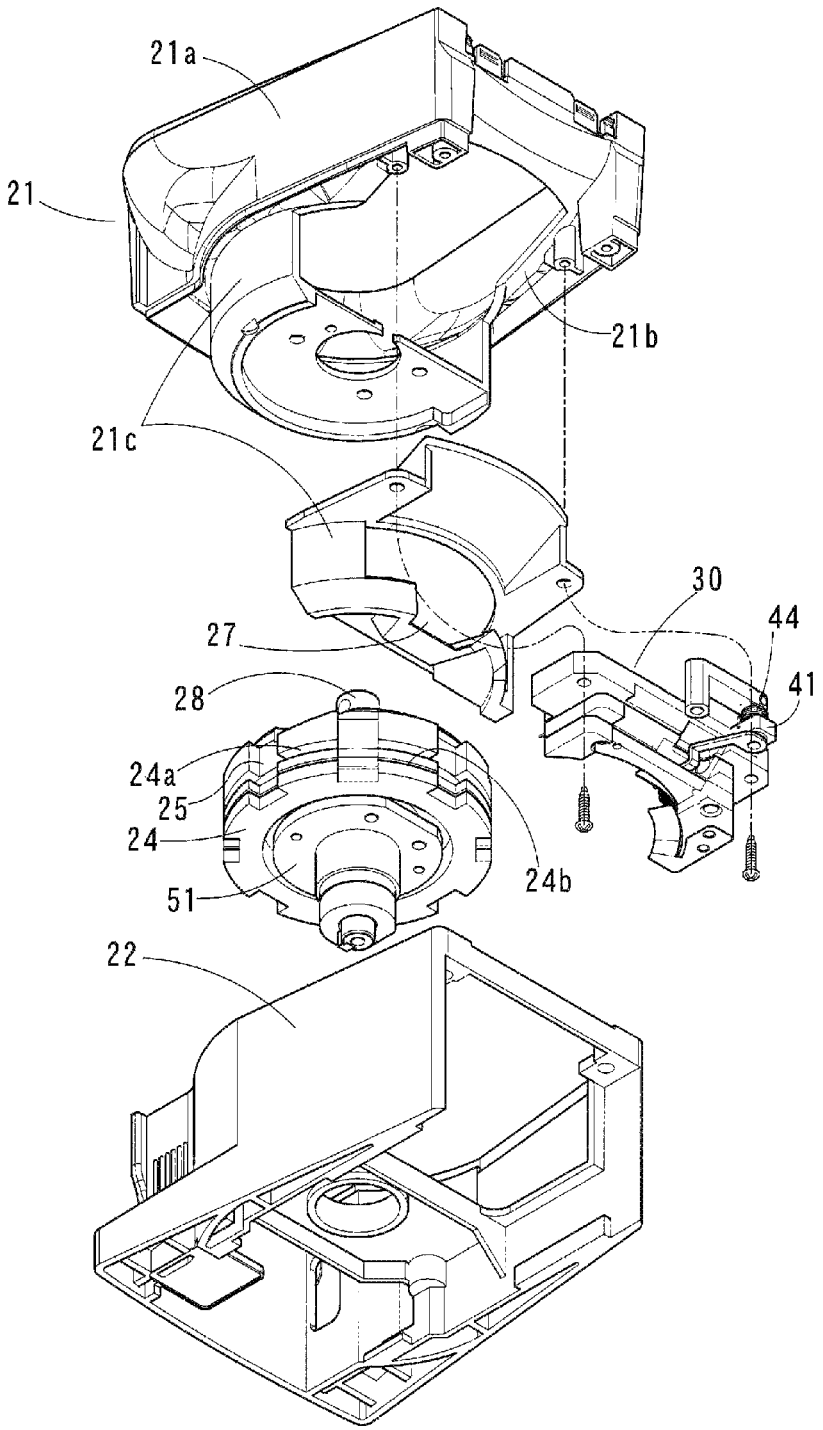
FIG. 6 is an exploded perspective view showing the tablet cassette according to one embodiment of the present invention when viewed from the bottom of the tablet cassette.

The tablet divider 30 is installed at an upper portion of the discharge port 27 (lateral side of the cylindrical part 21*c*) formed in the container 21 of the tablet cassette 20 (see, FIG. 5). The tablet divider 30 includes an attachment block 31 having three flat plates 31*a*, 31*b* and 31*c* overlapped with each other, a partition member 32 including a brush, which is fixed while being gripped by two flat plates 31*a* and 31*b* at an upper portion of the attachment block 31, a fixing blade 33, which is fixedly gripped by two flat plates 31*b* and 31*c* at a lower portion of the attachment block 31, and a flake-shape lower guide 34 including a spring member screw-fixed to a bottom surface of the lower flat plate 31*c*.

The partition member 32 is inserted into an upper peripheral groove 24*a* formed at a lateral side of the rotor 24. As the rotor 24 is rotated, the partition member 32 is introduced into the pocket part 25 facing the discharge port 27, thereby dividing the pocket part 25 into an upper portion and a lower portion. Thus, the tablet T located at the lower portion of the pocket part 25 is divided from the tablet T located at the upper portion of the pocket part 25 (see, FIGS. 12(*a*) and (*b*)).

The fixing blade 33 is introduced into a lower peripheral groove 24*b* formed at the lateral side of the rotor 24. As the rotor 24 is rotated in the horizontal direction, the fixing blade 33 divides the tablet T in the pocket part 25 facing the discharge port 27 by cutting the center of the tablet T in the transverse direction (see, (a) to (c) of FIGS. 12 and 13). A tip 33*a* of the fixing blade 33 has a concave arc shape, which gradually protrudes toward the rotor 24 in the movement direction of the tablet T (from the left to the right in FIG. 13), so the tip 33*a* of the fixing blade 33 may be gradually inserted into the tablet T when dividing the tablet T (see, FIGS. 13(*a*) to (*c*)).

Figure 13:
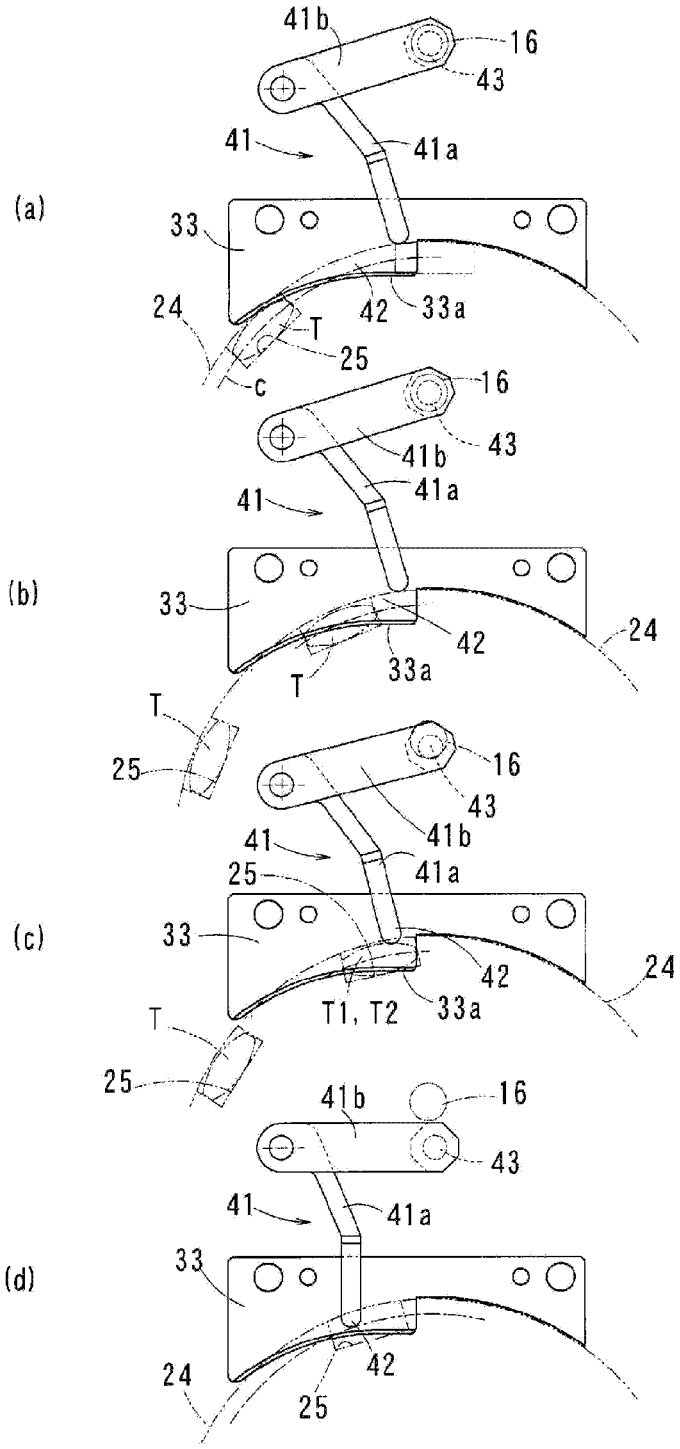
FIGS. 13(*a*) to 13(*d*) are plan views schematically showing the tablet division according to one embodiment of the present invention.
Figure 14:
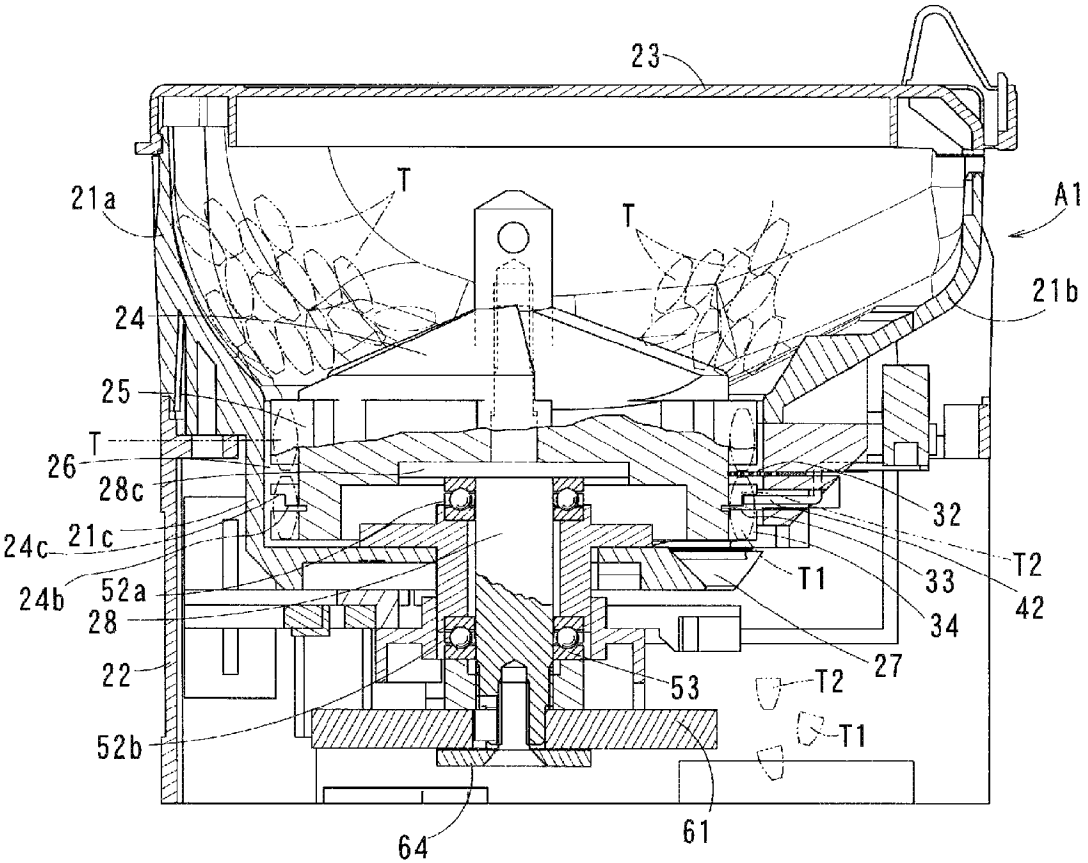
FIG. 14 is a side sectional view showing a tablet cassette according to another embodiment of the present invention.
Figure 15:
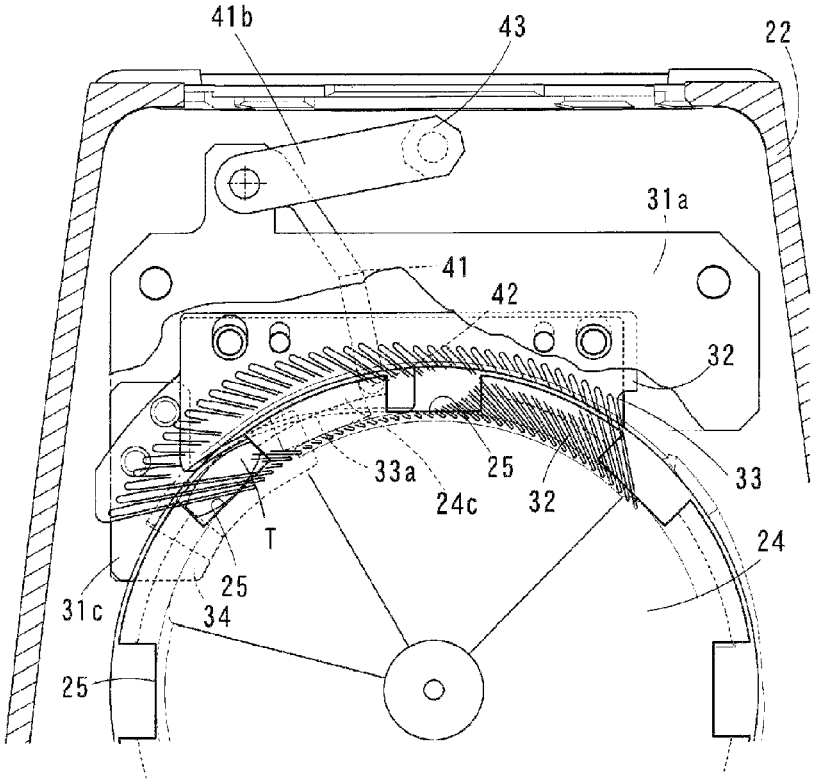
FIG. 15 is a top sectional view showing the tablet cassette according to another embodiment of the present invention.
Figure 16:
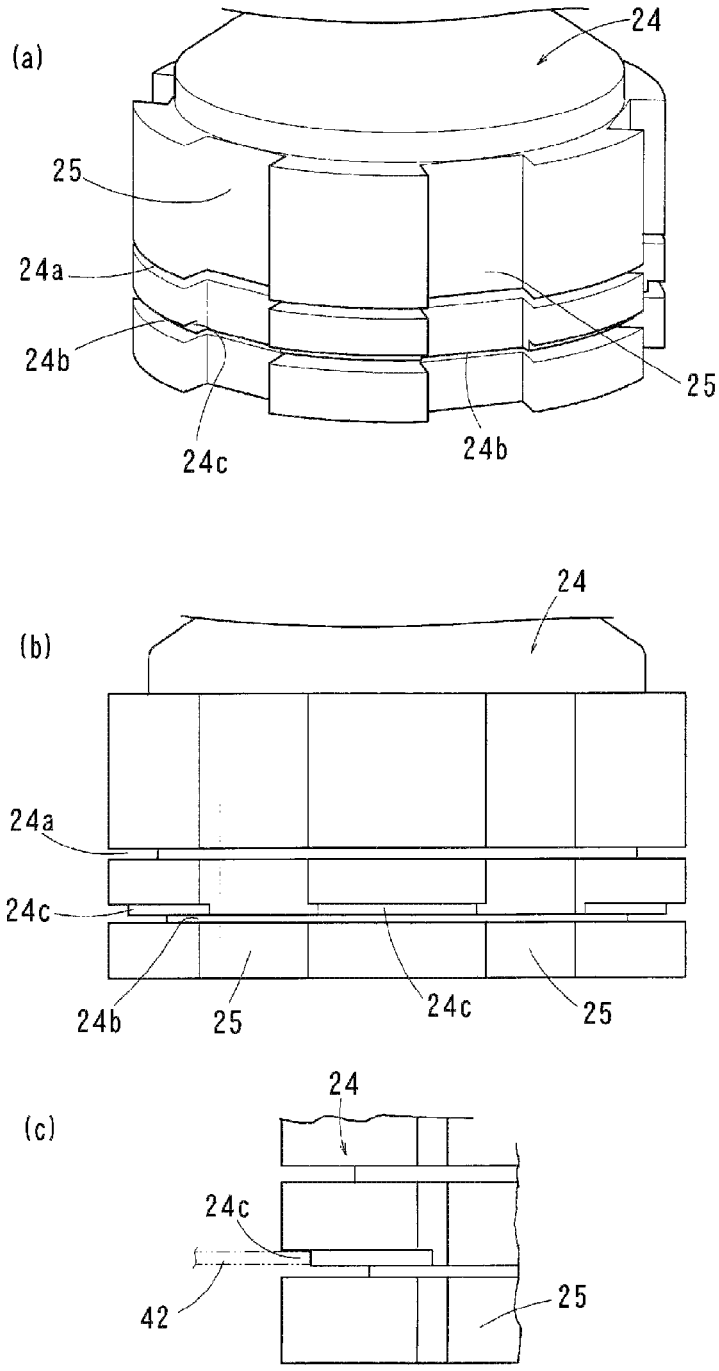
FIG. 16 is a view showing a rotor of the tablet cassette according to another embodiment of the present invention, in which (a) is a perspective view of a main part, (b) is a front view of the main part, and (c) is a partial front view to explain the operation of the main part.

In addition, the front and rear positions of the fixing blade 33 (protruding degree toward the rotor 24) can be adjusted. For instance, in the case of the tablet T coated with a predetermined material, such as a sugar-coated tablet, the tip 33*a* has a length (protruding degree) sufficient to pass through the tablet T in order to completely divide the tablet T. In addition, in the case of the tablet made by curing powder, as shown in FIG. 13(*c*), the tablet T can be sufficiently divided even if the length of the tip 33*a* does not pass through the tablet T. Thus, the length of the tip 33*a* is properly set according to the shape and property of the tablet T.

Figure 12:
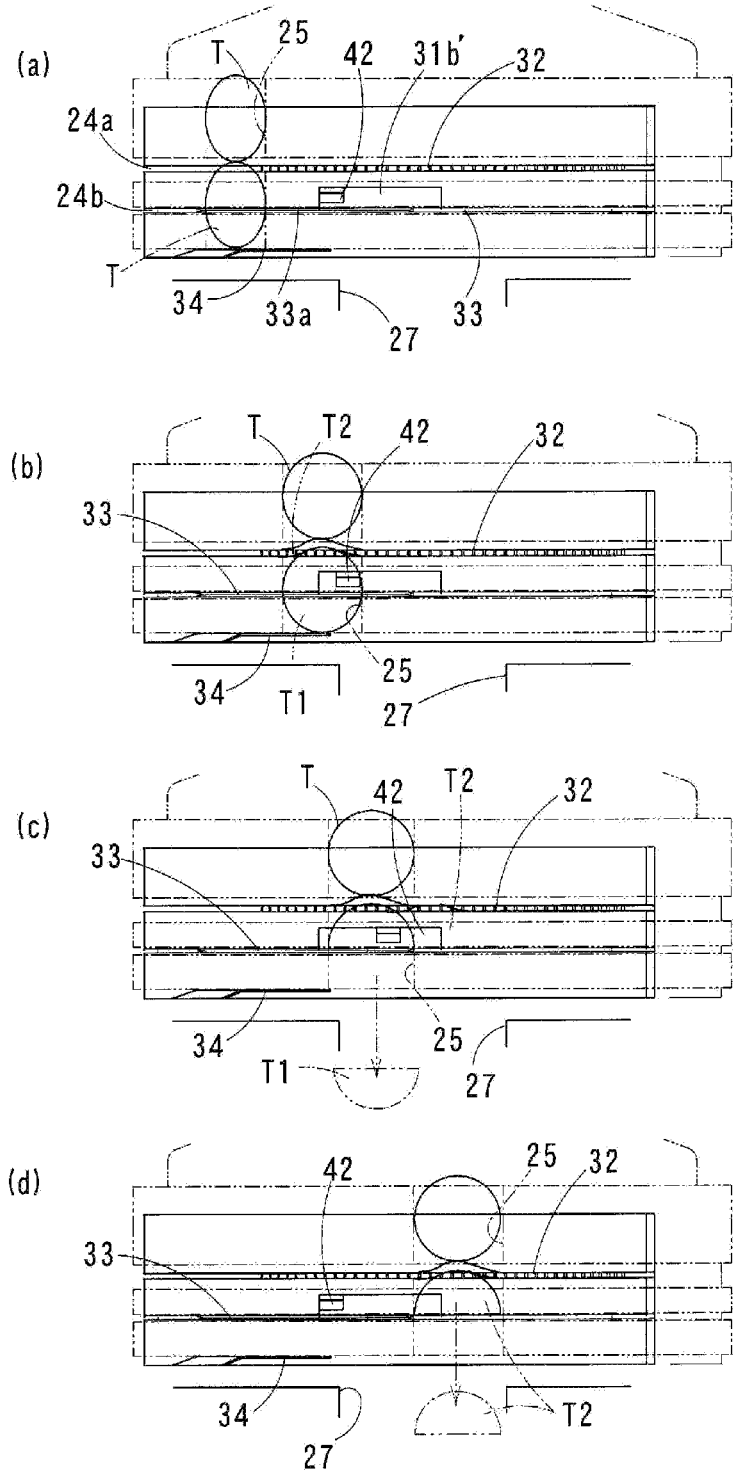
FIGS. 12(*a*) to 12(*d*) are front views schematically showing the tablet division of the tablet cassette according to one embodiment of the present invention.

The lower guide 34 makes contact with the tablet T received in the pocket part 25 facing the discharge part 27 and gradually pushes the tablet T in the upward direction as the rotor 24 is rotated, thereby pressing the tablet T against the fixing blade 33. At this time, as shown in FIG. 12, a sliding contact surface (top surface) of the lower guide 34 includes a first horizontal surface, an inclined surface inclined upward from the first horizontal surface, and a second horizontal surface extending from the inclined surface. At the region between the first horizontal surface and the inclined surface, the fixing plate 33 is inserted into the center of the tablet T (see, FIG. 12(*a*) and FIG. 13(*a*)). Then, while the tablet T is moving along the second horizontal surface, the tablet T makes contact with the fixing blade 33 while being pressed by the lower guide 34 and the eating clearance of the fixing blade 33 with respect to the tablet T is compensated by the elastic deformation of the lower guide 34 in the downward direction (see, FIGS. 12(*a*) to 12(*c*))

As shown in FIG. 12(*a*) and FIG. 13(*a*), the fixing blade 33 is inserted into the tablet T as the rotor 24 is rotated, thereby dividing the tablet T into the upper and lower half-size tablets 12 and 11 (see, FIGS. 12(*b*) and 12(*c*) and FIGS. 13(*b*) and 13(*c*)). At this time, the fixing blade 33 is inserted into the center of the tablet T while being supported by the lower guide 34 having elasticity, so the tablet T can be smoothly divided while minimizing the amount of the fragments.

In detail, the tablet T is divided into the upper and lower half-size tablets T2 and T1 as the rotor 24 is rotated. The lower half-size tablet T1 is dropped down to the discharge port 27 (see, FIG. 13(*c*)) upon the tablet T is divided, and, as the rotor 24 further rotates, the upper half-size tablet T2 is dropped down to the discharge port 27 from the front end of the fixing blade 33 serving as the support plate (see, FIG. 13(*d*)).

In this manner, as the rotor 24 rotates in one direction (movement to one direction of the tablet T), the tablet T is divided into two parts and the upper and lower half-size tablets T2 and T1 are supplied one by one with predetermined time difference (angle difference of 22.5°). Therefore, if one half-size tablet must be included in one dosage for a patient based on the prescription and if nine half-size tablets must be individually packaged (odd packages; morning, afternoon, and evening for three days), the rotation of the rotor 24 is stopped in a state that the upper half-size tablet T2 is kept on the front end of the fixing blade 33. In addition, if a patient needs to take one half-size tablet in the morning and afternoon for four days based on the prescription, eight half-size tablets must be individually packaged (even packages). In this case, the rotation of the rotor 24 is stopped as the upper half-size tablet T2 placed on the front end of the fixing blade 33 has been supplied to the discharge port 27. In addition, when it is necessary to supply the half-size tablet after the odd half-size tablets have been supplied, the half-size tablet 12 kept on the fixing blade 33 is supplied as the first half-size tablet. In FIG. 13, c represents the moving trace of the center of the tablet T.

Figure 8:
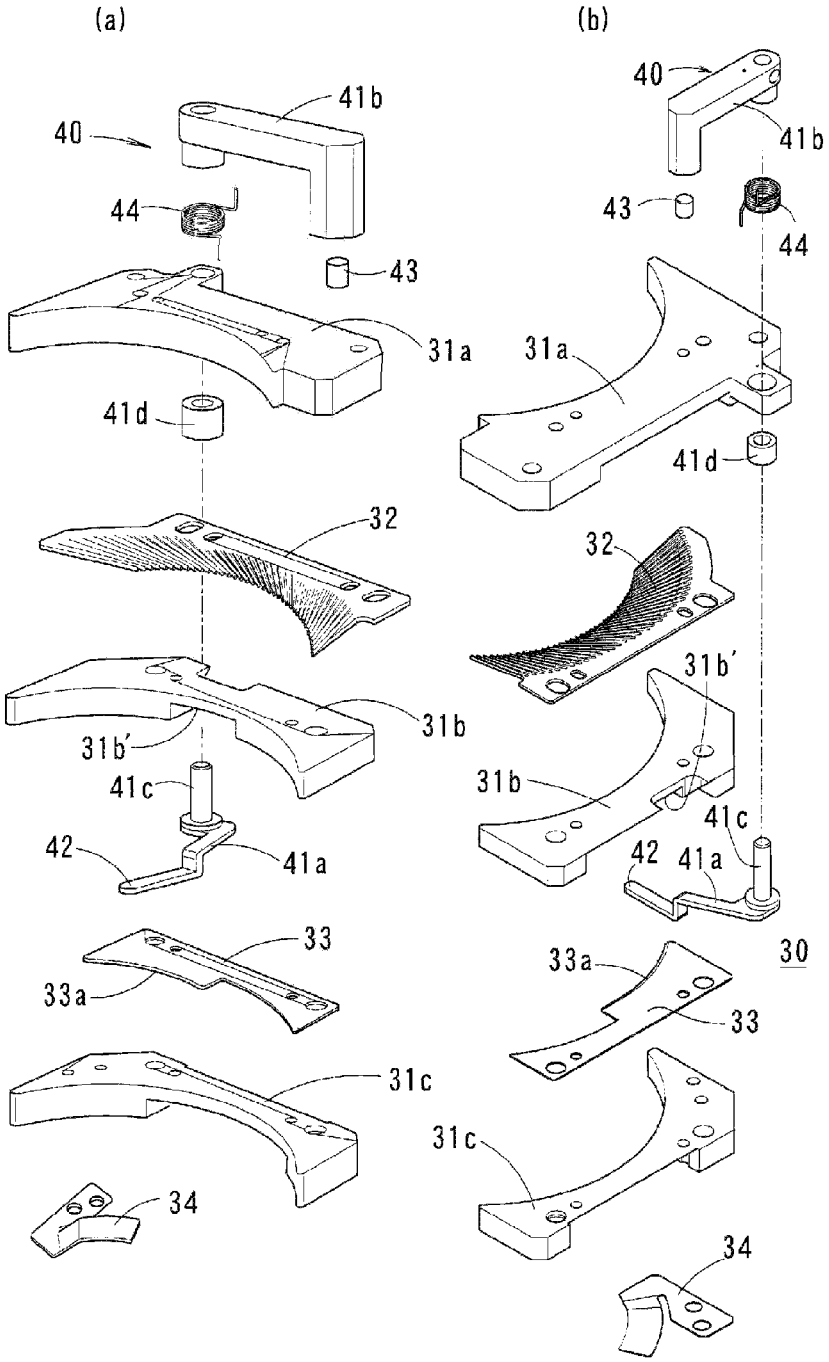
FIG. 8 is an exploded perspective view showing a tablet divider of the tablet cassette according to one embodiment of the present invention, in which (a) shows the tablet divider when viewed from a front top of the tablet divider and (b) shows the tablet divider when viewed from a rear top of the tablet divider.
Figure 9:
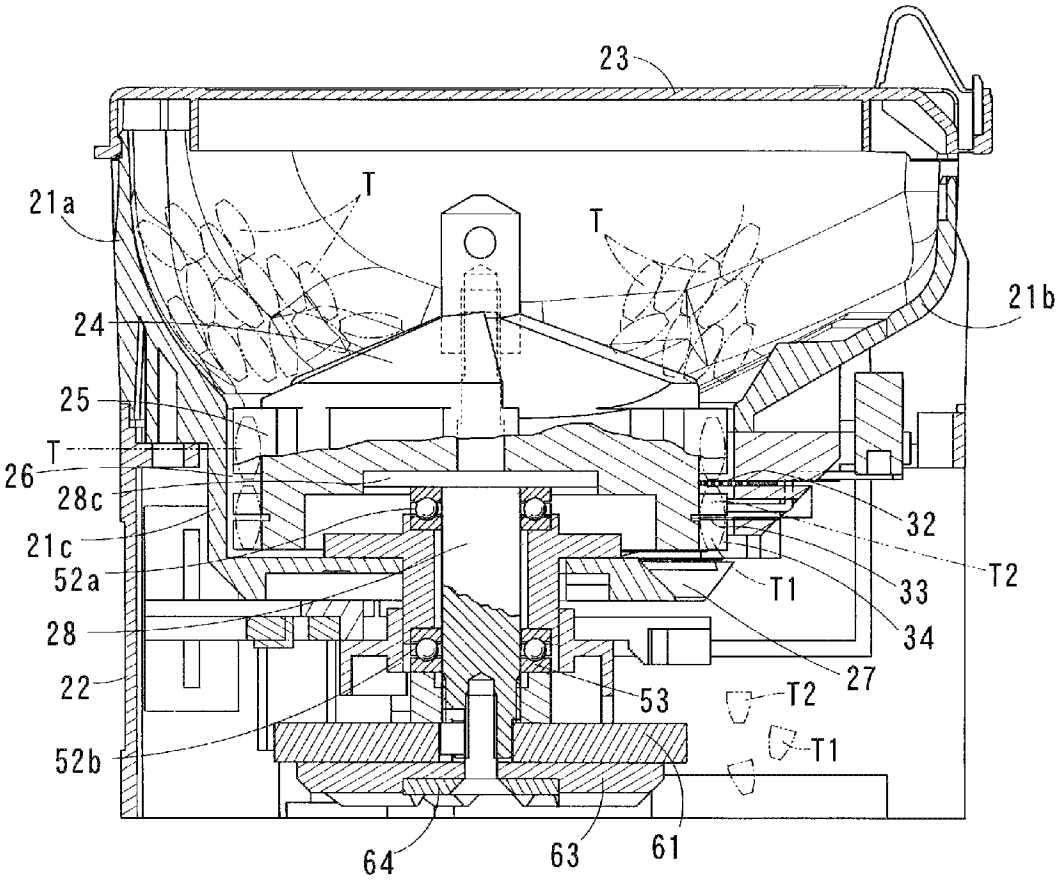
FIG. 9 is a side sectional view showing the tablet cassette according to one embodiment of the present invention.
Figure 10:
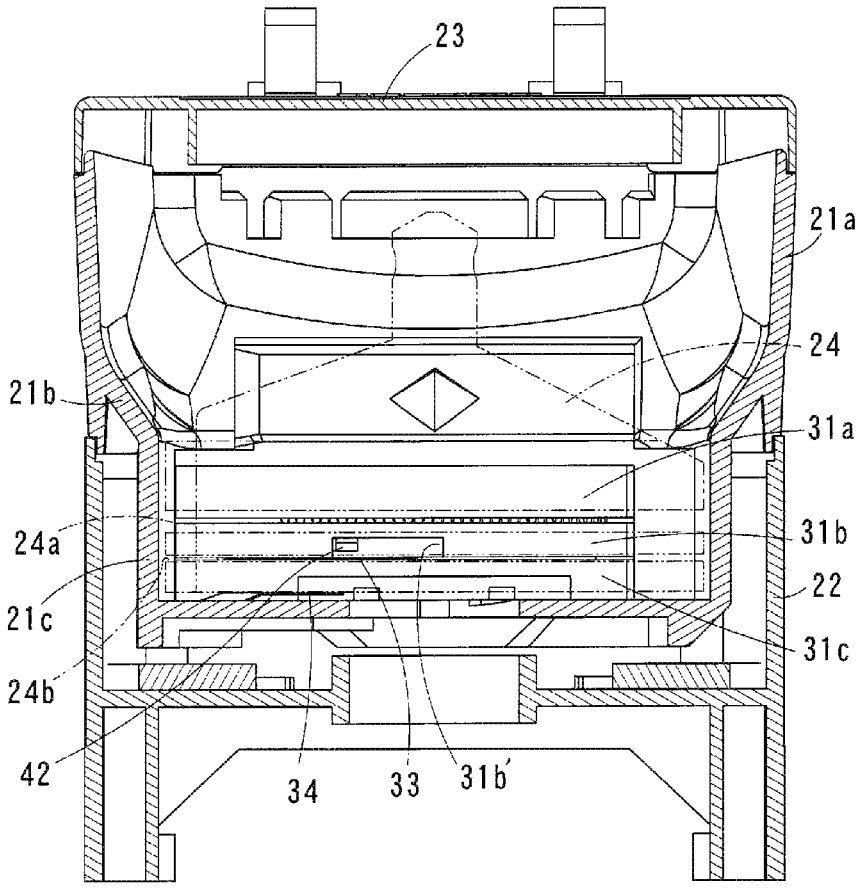
FIG. 10 is a rear sectional view showing the tablet cassette according to one embodiment of the present invention.
Figure 11:
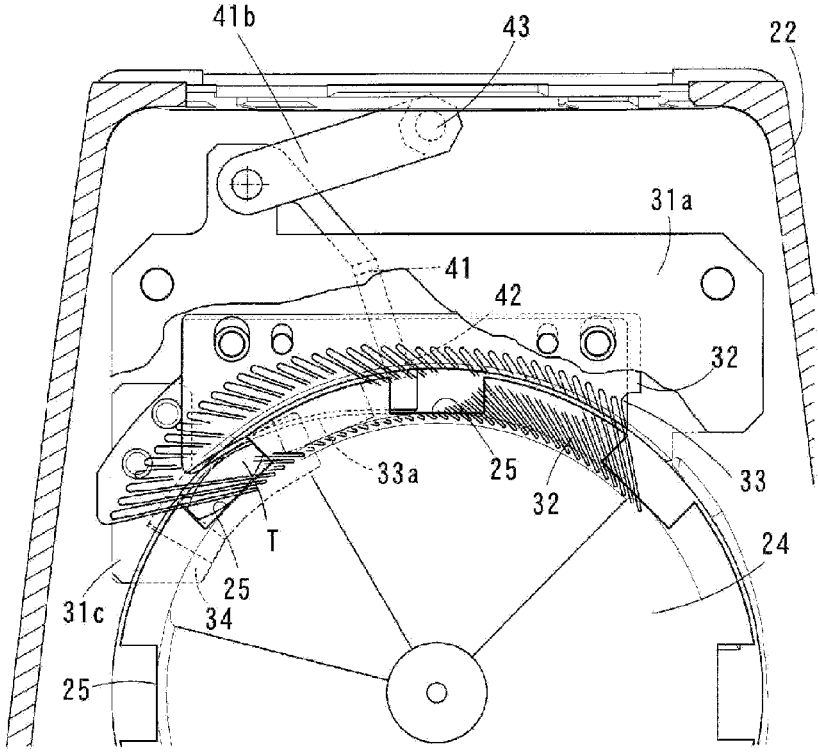
FIG. 11 is a top sectional view showing the tablet cassette according to one embodiment of the present invention.

The tablet detecting sensor 40 for the upper half-size tablet T2 is installed on the block 31 of the tablet divider 30 (see, FIG. 8). The tablet detecting sensor 40 includes an arm (actuator 41) swingably installed on the flat plate 31*a* of the block 31, the wiper 42 provided at the front end of the arm 41, the magnet 43 provided at the other end of the arm 41, the spring 44 biasing the arm 41 toward the rotor 24, and a magnetic sensor 16 of the mounting table 11. The arm 41 is divided into two members 41*a* and 41*b*. A shaft 41*c* of one member 41*a* adjacent to the wiper 42 is rotatably inserted into the hole of the flat plate 31*a* through a bush 41*b* and then the shaft 41*c* is screw-fixedly inserted into the other member 41*b* adjacent to the magnet 43.

In general, one member 41*a* of the arm 41 adjacent to the wiper 42 makes contact with the sidewall of the wiper 42 by passing through an opening 31*b*' of the flat plate 31*b* (see, FIG. 12(*a*)), so that the wiper 42 may be introduced into the pocket part 25 while slidably moving along the lateral side of the rotor 24 (see, FIGS. 13(*a*) and 13(*b*)). When the wiper 42 slidably moves, the magnet 43 faces the magnetic sensor 16 (see, FIGS. 13(*a*) 13(*b*)). Thus, as shown in FIG. 13(*d*), when the tablet T is absent in the pocket part 25 and the wiper 42 is introduced into the pocket part 25 due to the swing of one member 41*a* toward the rotor 24, the magnet 43 is offset from the magnetic sensor 16, so that the absence of the tablet T (half-size tablet T2) in the pocket part 25 can be detected. If the tablet T (half-size tablet T2) exists in the pocket part 25, the wiper 42 slidably moves along the surface of the tablet T, so the magnet 43 substantially faces the magnetic sensor 16 (see, FIG. 13(*c*)).

Figure 7:
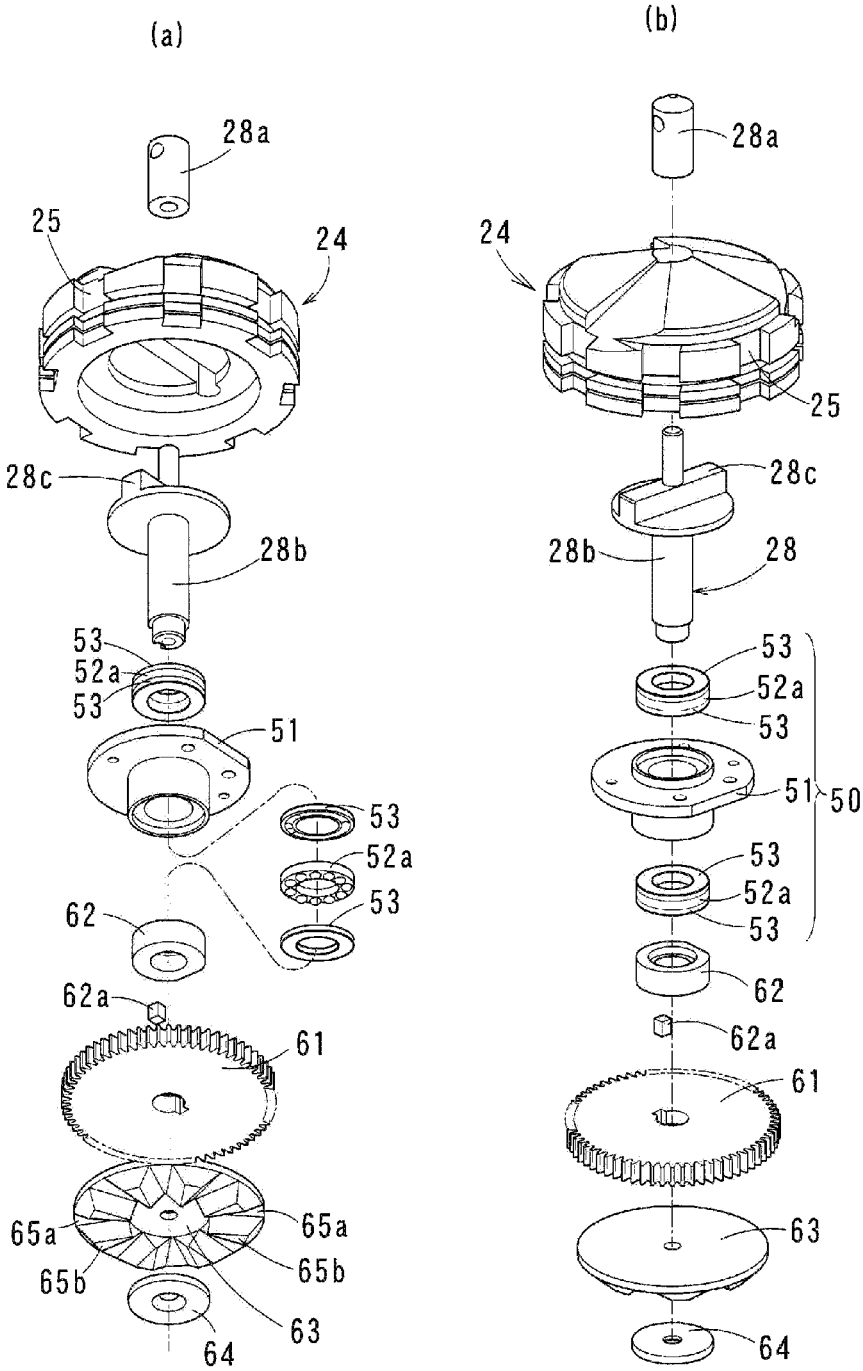
FIG. 7 is an exploded perspective view showing a rotor part of the tablet cassette according to one embodiment of the present invention, in which (a) shows the rotor part when viewed from a front bottom of the rotor part and (b) shows the rotor part when viewed from a front top of the rotor part.

As shown in FIG. 7, the rotating shaft 28 of the rotor 24 is divided into an upper shaft 28*a* and a lower shaft 28*b*. A rib 28*c* of the lower shaft 28*b* is inserted into a groove formed at the bottom surface of the rotor 24 and then the upper shaft 28*a* is inserted into an upper end of the lower shaft 28*b* so that the rotating shaft 28 is fixedly integrated with the rotor 24.

A bearing unit 50 is installed on the support part 22 for the rotating shaft 28. As shown in FIG. 7, the bearing unit 50 includes a bearing support 51 screw-fixed to the support part 22, upper and lower thrust bearings 52*a*, 52*a*, and a bearing pusher 53. Since the rotating shaft 28 is supported by the upper and lower thrust bearings 52*a*, 52*a*, the rotating shaft 28 can be smoothly and precisely rotated without being fluctuated.

The large-size gear 61 is attached to a lower end of the rotating shaft 28 by a boss 62 and a key 62*a*. In addition, the disc 63 is fixed to the lower end of the large-size gear 61 by a stopper ring 64. The concavo-convex sections are formed on an entire peripheral portion of the bottom surface of the disc 63. The concavo-convex sections include concave sections 65*a* and convex sections 65*b*, which are spaced apart from each other at a regular interval of 22.5°. That is, the concavo-convex sections have intervals equal to the intervals of the pocket parts 25 of the rotor 24 and the convex sections 65*b* correspond to the pocket parts 25.

Accordingly, if the tablet cassette 20 is mounted on the mounting table 11, the actuator 15 of the micro-switch makes contact with the concavo-convex sections formed on the bottom surface of the disc 63. As the rotor 24 (disc 63) is rotated, the actuator 15 is fluctuated due to the concavo-convex sections, so that the micro-switch can detect the concave sections 65*a* and the convex sections 65*b*. Thus, the rotating angle (position) of the rotor 24 can be detected, so that the supply time for the lower and upper half-size tablets T1 and T2, which is accompanied with the division of the tablet T, can be precisely detected.

In addition, the existence of the upper half-size tablet T2 in the pocket part 25 facing the discharge port 27 can be detected by comparing the rotating angle of the rotor 24 with the detection signal of the tablet detecting sensor 40. That is, when the micro-switch detects the convex sections 65*b* and the magnet 43 faces the magnetic sensor 16 due to the contact between the wiper 42 and the tablet T2 (see, FIG. 13(*c*), in which the upper half-size tablet T2 received in the pocket part 25 exerts an action on the arm 41), "existence of the tablet T2" is determined, so the wiper 42 is introduced into the pocket part 25. In addition, if the magnet 43 offsets from the magnetic sensor 16 (see, FIG. 13(*d*), in which the upper half-size tablet T2 is absent in the pocket part 25, so no action is applied to the arm 41), "absence of the tablet T2" is determined.

Therefore, when the tablet cassette 20 is set again after it has been separated under the specific circumstances, the existence and absence of the upper half-size tablet T2 can be instantly detected through the above comparison. That is, even if the upper half-size tablet T2 kept on the fixing blade 33 when the tablet cassette 20 is separated is absent when the tablet cassette 20 is set again due to the specific regions, such as dropping of the tablet T2 during the transportation of the tablet cassette 20, the absence of the tablet T2 can be detected so that the error may not occur when supplying the tablets. The pocket parts 25 may correspond to the concave sections 65*a*, instead of the convex sections 65*b*. In this case, the micro-switch detects the concave sections 65*a*.

The pharmaceutical feeding (charging) apparatus including the tablet feeder A or the tablet division feeder A1 has the above structure and operation. When the feeding (charging) operation is performed, feeding information is input into the tablet division feeder A1 and the rotor 24 is rotated by a desired RPM to divide the tablets, so that a desired amount of half-size tablets T1 and T2 can be supplied.

Regarding the rotation of the rotor 24, the rotating angle of the rotor 24 is set according to the number of half-size tablets T1 and T2 to be supplied. For instance, since eight recesses 25 are formed at the lateral side of the rotor 24, sixteen half-size tablets T1 and T2 are supplied as the rotor 24 is rotated one time. Thus, if it is necessary to feed fourteen half-size tablets T1 and T2, the rotor 24 is rotated at angle of 315° ($360° \times 14/16$). According to the present embodiment, the rotor 24 may continuously rotate until the desired rotating angle is achieved. However, the rotor 24 can intermittently rotate at an angle of 22.5° whenever the half-size tablet is supplied.

FIGS. 14 to 17 show another embodiment of the present invention. According to another embodiment of the present invention, the peripheral groove 24*b* for the lower cutter 33 has the two-step structure and the peripheral groove 24*c*, into which the wiper 42 is inserted, is formed in the entire lateral surface of an upper portion of the rotor 24 (see, FIG. 15). The wiper 42 inserted into the peripheral groove 24*c* is located in the movement path c of the tablet T (upper half-size tablet T2) (see, FIG. 17(*a*)).

Figure 17:
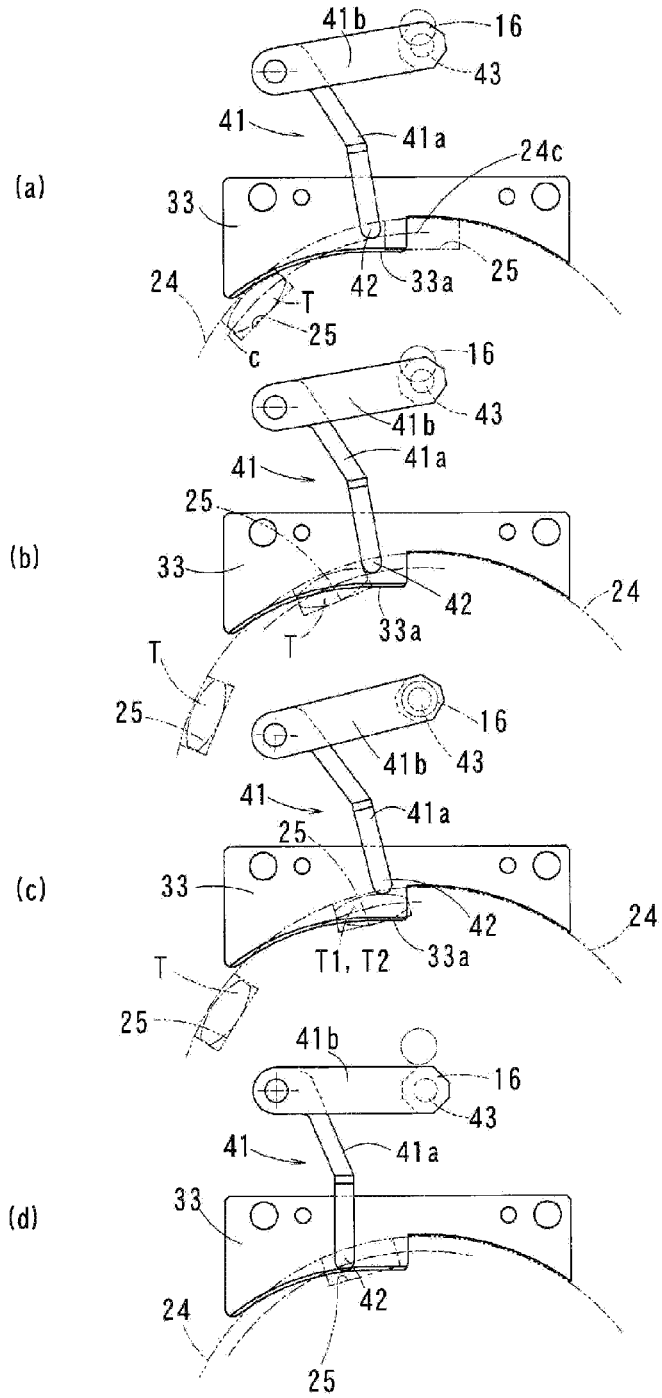
FIGS. 17(*a*) to 17(*d*) are plan views schematically showing the tablet division of the tablet cassette according to another embodiment of the present invention.

Therefore, when the wiper 42 slidably moves along an inner wall of the peripheral groove 24*c*, the magnet 43 is offset from the magnetic sensor 16 (see, FIG. 17(*a*)). If the wiper 42 is introduced into the pocket part 25 having no tablet T (upper half-size tablet 12), as shown in FIG. 17(*d*), the member 41*a* is fluctuated toward the rotor 24, so that the magnet 43 is separated far away from the magnetic sensor 16.

Meanwhile, if the tablet T (upper half-size tablet T2) exists in the pocket part 25, since the wiper 42 is located in the movement path c of the tablet, the tablet T (upper half-size tablet T2) makes contact with the wiper 42 while pressing the wiper 42 as the tablet T (upper half-size tablet T2) is moved, so that the wiper 42 is fluctuated (see, FIGS. 17(*b*) and 17(*c*)). Thus, the magnet 43 faces the magnetic sensor 16 according to the fluctuation, so that the existence and absence of the tablet T (upper half-size tablet T2) can be accurately detected (see, FIG. 17(*c*)).

In this manner, the wiper 42 may fluctuate according to the existence and absence of the tablet T (upper half-size tablet T2) so that the existence and absence of the tablet T (upper half-size tablet T2) can be accurately detected. Thus, the signal comparison by using the actuator 15 of the micro-switch and the disc 63 may not be necessary. Therefore, the disc 63 and the micro-switch (actuator 15) can be omitted (see, FIG. 20).

Figure 18:
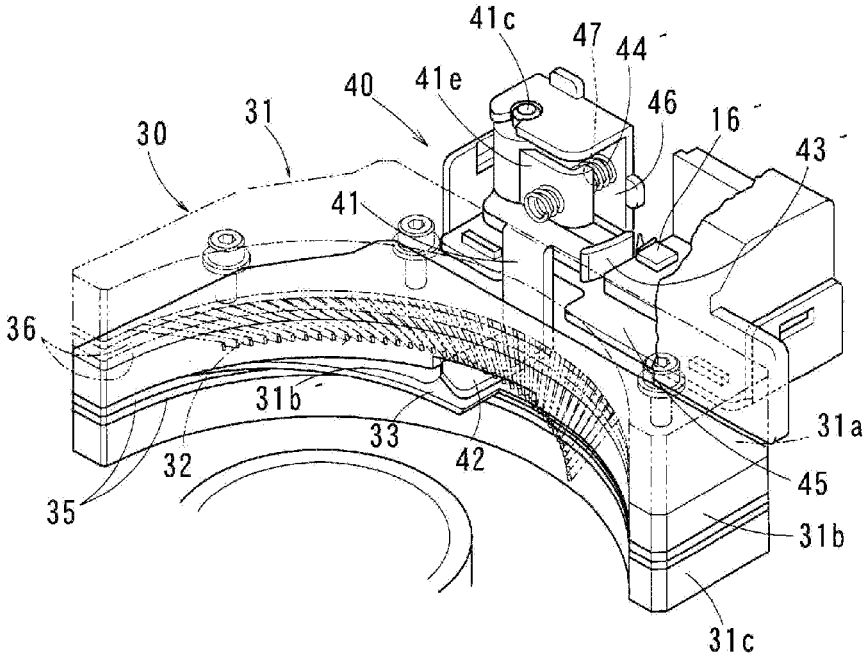
FIG. 18 is a perspective view showing a tablet detecting sensor according to another embodiment of the present invention.
Figure 19:
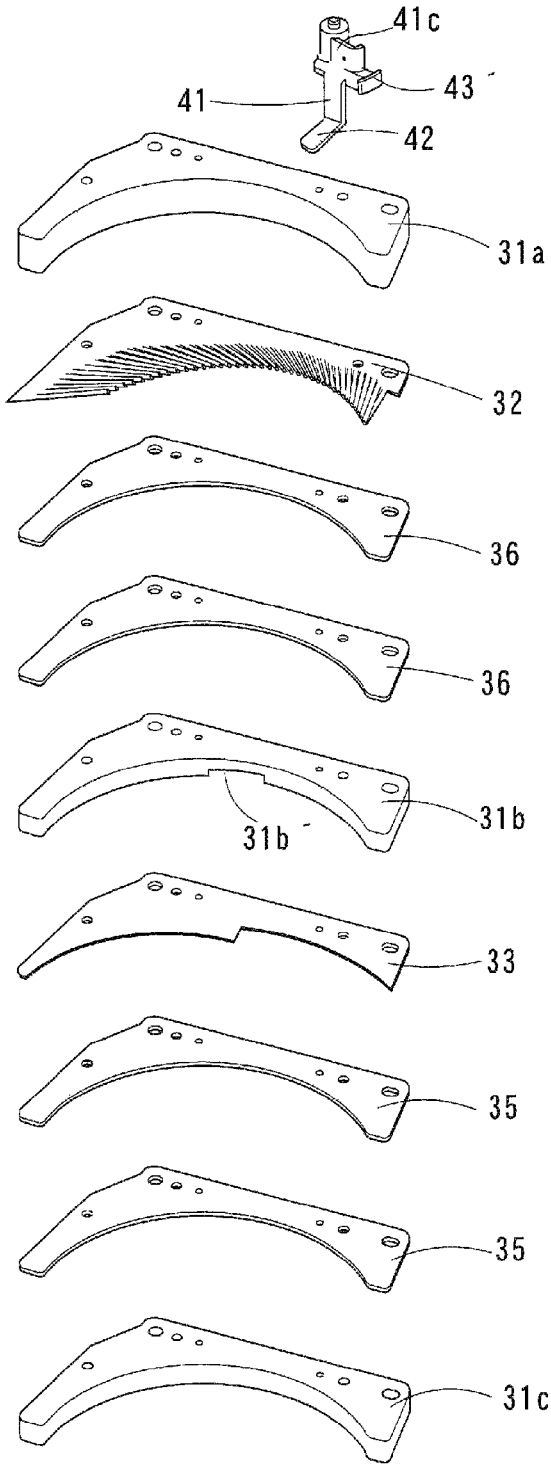
FIG. 19 is an exploded perspective view showing main parts of the tablet detecting sensor according to another embodiment of the present invention.

FIGS. 18 and 19 show a tablet detecting sensor according to another embodiment. According to the present embodiment, an attachment plate 45 is attached to a cassette container 21 at the rear of the tablet divider 30, and the actuator (arm 41) is swingably installed to the attachment plate 45 by a shaft 41*c*. In addition, a micro-switch 16' is installed instead of the magnetic sensor 16, which is turned on/off by the actuator 41. Thus, the magnetic sensor 16 is omitted (see, FIG. 32).

The actuator 41 has a flange, which is erected from the rear end of the wiper 42 and then extends in the horizontal direction and into which the shaft 41*c* is inserted. A coil of a coil spring 44', which is coupled with a protrusion 47 of an erecting plate 46 of the attachment plate 45, passes through an erecting plate 41*e* adjacent to the flange. The penetration degree (length) of the coil spring 44' can be adjusted by rotating the coil spring 44', so that the protruding degree of the wiper 42 with respect to the opening 31*b'* of the flat plate 31*b* (the insertion degree of the wiper 42 with respect to the peripheral groove 24*c*) can be adjusted.

In such a tablet detecting sensor, if the tablet T (upper half-size tablet T2) exists in the pocket part 25, the wiper 42 is pressed by the tablet T (upper half-size tablet T2), so that the actuator 41 is fluctuated against the spring 44' and the micro-switch 16' is operated by an operator 43', thereby detecting the tablet T (upper half-size tablet T2).

In addition, since the disc 63 is installed, if the tablet detecting signal is compared with the detecting signal obtained from the disc 63 and the micro-switch, the existence and absence of the tablet T (upper half-size tablet T2) can be more accurately detected.

Further, according to the present embodiment, plate-shape spacers 35 and 36 (two spacers in the present embodiment) are interposed between the fixing blade 33 and the lower flat plate 31*c* and between the fixing blade 33 and the partition member 32. In this case, the fixing blade 33 is located at the longitudinal center of the tablet T, which is positioned by the lower guide 34 in the pocket part 25, so that the tablet T can be accurately divided into the lower and upper half-size tablets T1 and T2. In addition, the partition member 32 is accurately located between two tablets T received in the pocket part 25, thereby partitioning one tablet T from the other tablet T. To this end, the thickness or the number of the spacers 35 and 36 must be properly selected depending on the size (height) of the tablet T to allow the fixing blade 33 and the partition member 32 to be located in the above position.

The position adjustment for the fixing blade 33 and the partition member 32 by using the spacers 35 and 36 may be performed in a state in which the tablet divider 30 (block 31) is separated from the tablet cassette 20. Thus, if the lower guide 34 interferes with the above position adjustment, the lower guide 34 may be fixed to the body of the tablet cassette 20, other than the block 31 (see, FIG. 22(*b*)).

The spacers 35 and 36 can be employed in the embodiment as shown in FIG. 1.

As described above, the tablet T (lower and upper half-size tablet T1, T2) fed (discharged) from the tablet cassette 20 is detected by the sensor 18 when the tablet T (lower and upper half-size tablet T1, T2) moves through the second path 14 and the number of the feeding tablets are calculated. Besides the tablet T (lower and upper half-size tablets T1 and T2), fragments t of the tablet T generated as the tablet T is divided may pass through the second path 14.

Thus, since the tablets are supplied in the predetermined period of time (since the rotor 24 rotates at a constant timing), if an object is supplied out of the predetermined period of time, that is, if a fragment t is dropped, the fragment can be omitted from counting. The counting accuracy, which is taken the supply timing into consideration, can be more improved by comparing the counting number with the detecting signal of the tablet detecting sensor 40 and so on.

In particular, if the tablet T is precisely or almost precisely fitted in the pocket part 25, the tablet T can be precisely divided. However, if the tablet T has a size and a shape, which are not precisely fitted in the pocket part 25, the defect may occur when dividing the tablet T, the tablet T may adhere to the fixing blade 33 or the fragments t may be generated. In addition, the upper half-size tablet T2 may be placed on the wiper 42 after the tablet has been divided into the lower half-size tablet T1 and the upper half-size tablet T2, so that the dropping timing of the upper half-size tablet T2 may be delayed. In addition, the detection accuracy of the tablet detecting sensor 40 may be degraded. For this reason, the counting is performed based on the supply timing of the tablets to improve the detection accuracy for the tablets.

In addition, the tablet detecting sensor 40 can be omitted. In this case, the process for detecting the existence and absence of the tablet T (upper half-size tablet T2) in the pocket part 25 may be omitted and the tablet in the pocket part 25 is detected based on the supply timing. For instance, when the tablet feeder is separated and then set again under the specific circumstance, if the upper half-size tablet T2 is removed, the tablet is not supplied even if the rotor 24 performs the supply operation because the upper half-size tablet T2 is not present in the pocket part 25. Thus, the upper half-size tablet T2 is supplied in the next supply operation, so that the upper half-size tablet T2 may not be normally supplied in the predetermined period of time. As a result, it can be determined that the supply operation is performed at the pocket part 25 having no upper half-size tablet T2.

In addition, the supply timing may vary depending on the size and the shape of the tablet T (half-size tablets T1 and T2), so it is preferred to previously set the timing (threshold values) for various tablets. The timing can be set through various schemes. For instance, the timing can be set through a dip switch scheme. The embodiment employing the dip switch scheme is shown in FIGS. 20 and 21.

Figure 20:
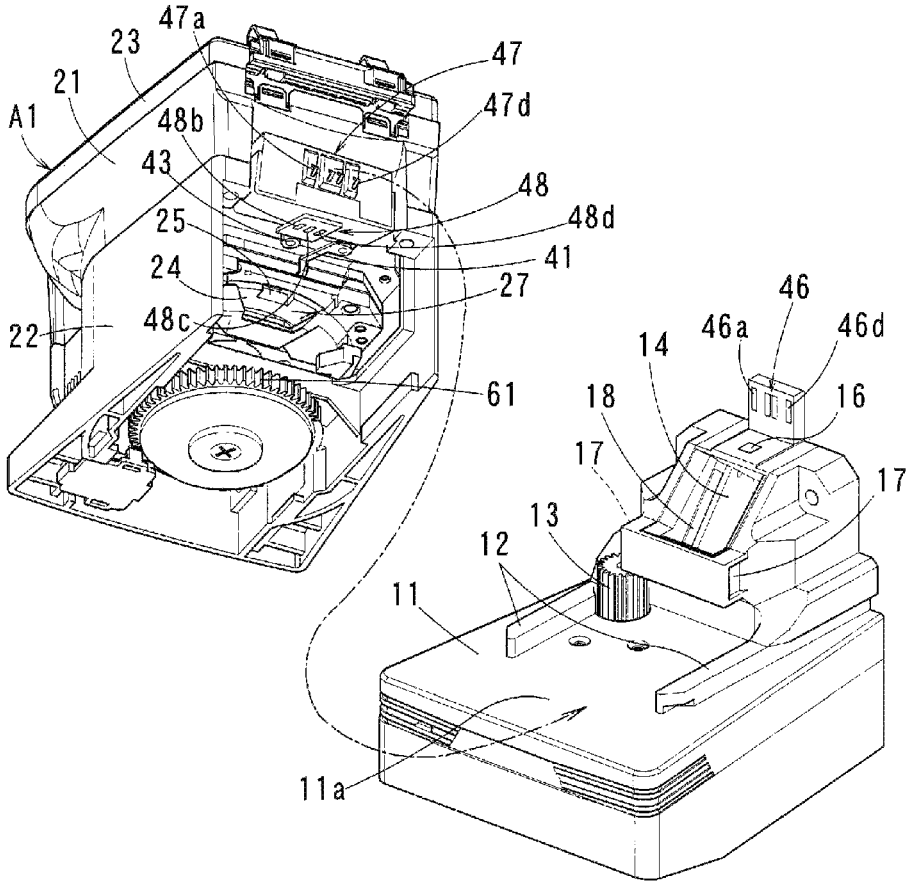
FIG. 20 is an exploded perspective view showing the tablet cassette and the mounting table thereof according to another embodiment of the present invention.
Figure 21:
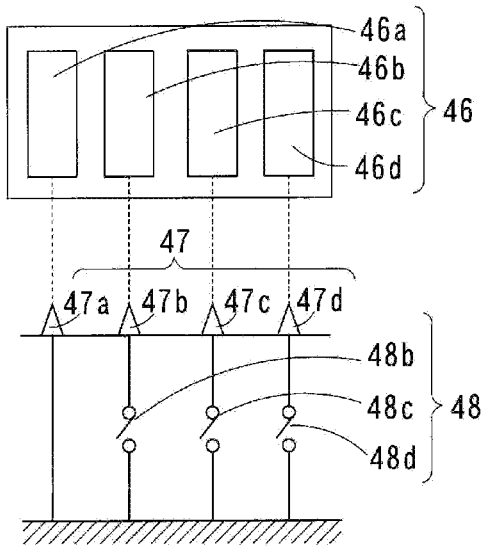
FIG. 21 is a circuit view showing a circuit to detect tablets according to another embodiment of the present invention.

As shown in FIGS. 20 and 21, a flat contact point 46 (46*a* to 46*d*) is formed on the mounting table (motor base 11), and an undulating contact point 47 (47*a* to 47*d*) is formed on the tablet cassette 20. In addition, an on/off switch 48 (48*b* to 48*d*) is formed in circuits of the undulating contact point 47.

The dip switch may have eight modes by properly setting the on/off state of the contact points 48*b*, 48*c* and 48*d* of the on/off switch 48. The eight modes can be set according to the size and the shape, etc of the tablet T accommodated in the cassette, and the timing (threshold value), which is set according to the size, etc of the tablet T, may be transferred (set) to the rotation controller (the controller detects the size of the tablet T accommodated in the tablet cassette).

Thus, if the table cassette 20 is set on the mounting table 11, the undulating contact point 47 makes contact with the flat contact point 46, so that the undulating contact point 47 is electrically connected with the flat contact point 46. At this time, the contact points 48*b*, 48*c* and 48*d* of the switch 48 are properly set to be on/off corresponding to the tablet T accommodated in the tablet cassette 20 and the set timing (threshold value) is transferred to the rotation controller of the rotor 24. Thus, the rotor 24 is rotated so that the lower and upper half-size tablets T1 and T2 are supplied at this timing. The lower and upper half-size tablets T1 and T2, which are supplied with predetermined timings based on the size, etc of the tablets T, are counted. At this time, objects supplied (dropped) out of the timing, such as fragments t, are not counted (omitted).

The number of the size, etc (timings) of the tablet T can be properly selected by properly setting the number of contacts 46 and 47.

If the same tablets T are accommodated in the tablet cassette 20 (if the switch 48 has the same setting), the tablet counting or the record for the existence and absence of the tablets is not reset even if the tablet cassette 20 is set again after it is separated. If the switch 48 has different settings, the record is reset when the tablet cassette 20 is set again.

In addition, if the sensor capable of distinguishing among the objects T, T1, T2 and t passing through the tablet path 14 based on the shape and the size of the objects is installed in the tablet path 14, it is possible to detect and count only the tablet T (lower and upper half-size tablets T1 and T2) regardless of the timing for the tablets. The sensor may not count the objects if the objects are fragments t, other than the tablet T (lower and upper half-size tablets T1 and T2).

For this reason, the above counting method (apparatus) can count the tablet T (lower and upper half-size tablets T1 and T2) regardless of the supply timing of the rotor 24, and the tablet T (lower and upper half-size tablets T1 and T2) can be accurately counted even if the tablets are fed at a high speed (high-speed rotation of the rotor).

Such a sensor is shown in FIG. 33 with reference numeral 19, in which the sensor has a large detection surface. Thus, when the tablets T, T1 and T2 pass through the tablet path 14 in various forms (see, FIG. 33(*a*)), the shape and the size of the tablets, such as a large diameter, a small diameter, a half size, and a thickness of the tablets T, T1 and T2, are detected by the sensor so that the type of the tablets can be detected. For instance, if the thickness, etc of the object passing through the tablet path 14 is smaller than that of the tablets T, T1 and T2, the object is determined as the fragment t. The threshold value for detecting the tablets T, T1 and T2 can be set by properly turning on/off the contact points 48*b*, 48*c* and 48*d* of the switch 48. According to the above counting method, eight types of the tablets T, T1 and T2 having different sizes and shapes can be detected by using the switch 48.

The counting apparatus based on the supply timing of the tablet, and the counting apparatus employing the sensor 17 may not be limited to the exemplary embodiments and may be applied to various tablet feeders according to the related art. For instance, the counting apparatus can be applied to the tablet feeder, in which a rotor is installed in a container for receiving a plurality of tablets such that a rotating shaft of the rotor is longitudinally arranged in the container, recesses are formed in an axial direction of the rotor along an entire lateral side of the rotor at a regular interval to receive the tablets, a rotor receiving part of the container has a tablet discharge port, and the tablets, which are accommodated in the recesses and move while being guided along an inner wall of the rotor receiving part as the rotor rotates, are sequentially discharged through the tablet discharge port. In addition, a rotary switch scheme can be adopted instead of the dip switch scheme.

In addition, the tablet detecting sensor 40 can be omitted. In this case, the number of feeding tablets T, T1 and T2 can be counted by the counting apparatus which counts the tablets based on the supply timing of the tablets or by the counting apparatus which counts the tablets T, T1 and T2 by using the sensor 19. In detail, the embodiment as shown in FIG. 22 can be considered.

Figure 22:
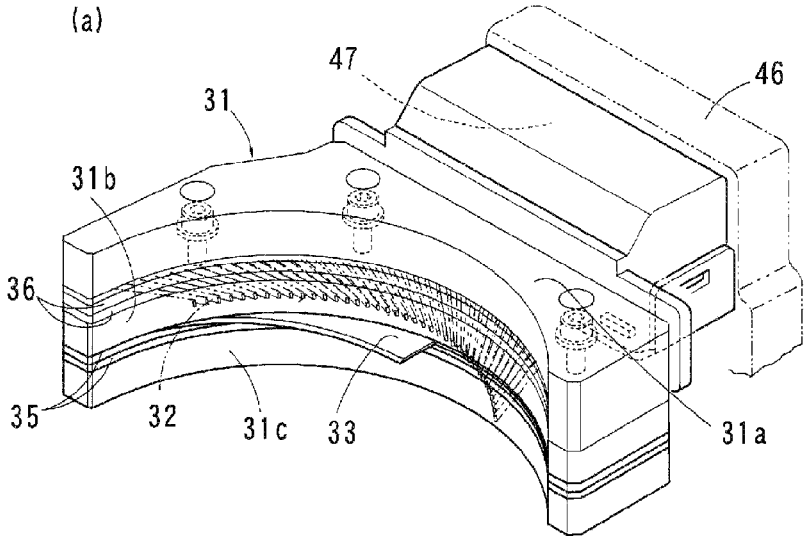
FIGS. 22(*a*) and 22(*b*) are perspective views showing main parts according to another embodiment of the present invention.
Figure 22:
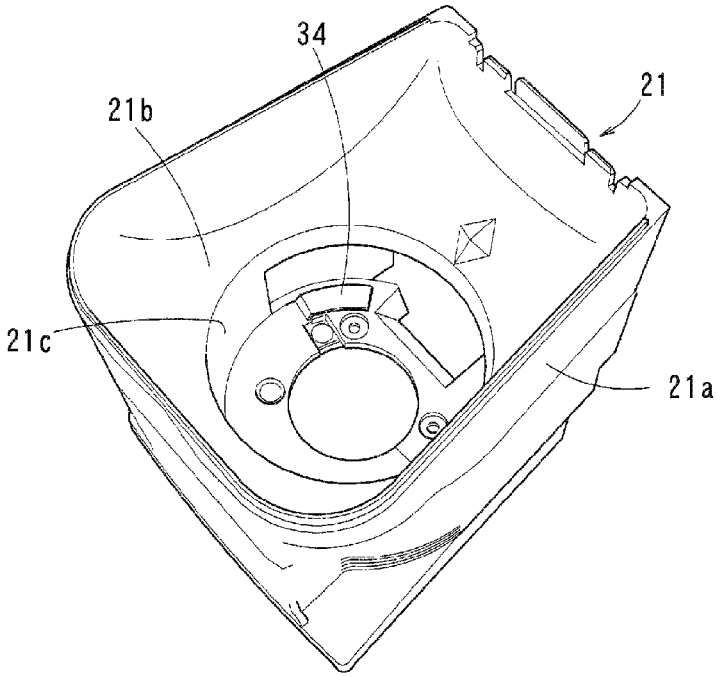

According to the above embodiment, the spacers 35 and 36 are provided as shown in FIG. 22(*a*), and the guide 34 is installed in the body of the tablet cassette as shown in FIG. 22(*b*).

Figure 23:
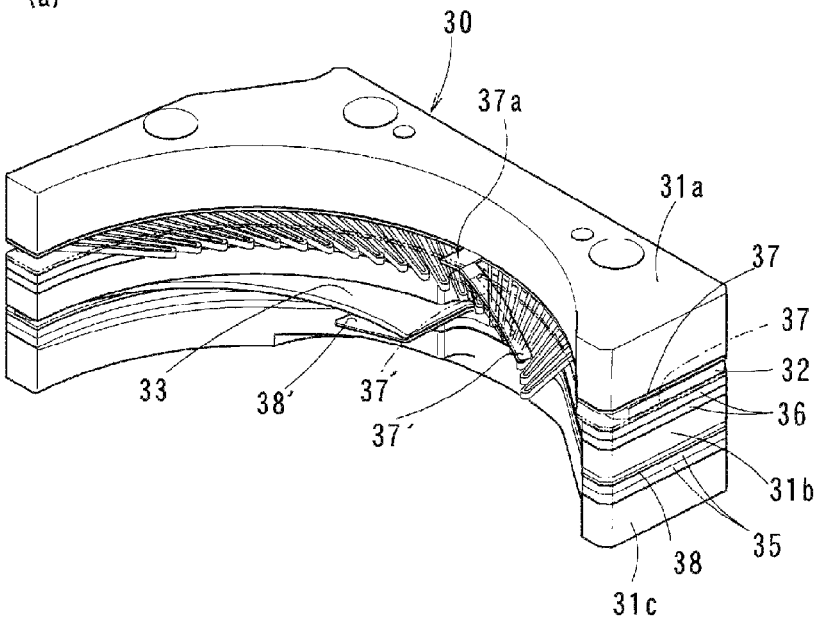
FIG. 23 is a view showing a tablet divider according to another embodiment of the present invention, in which (a) is a perspective view and (b) is a partial front view.
Figure 23:
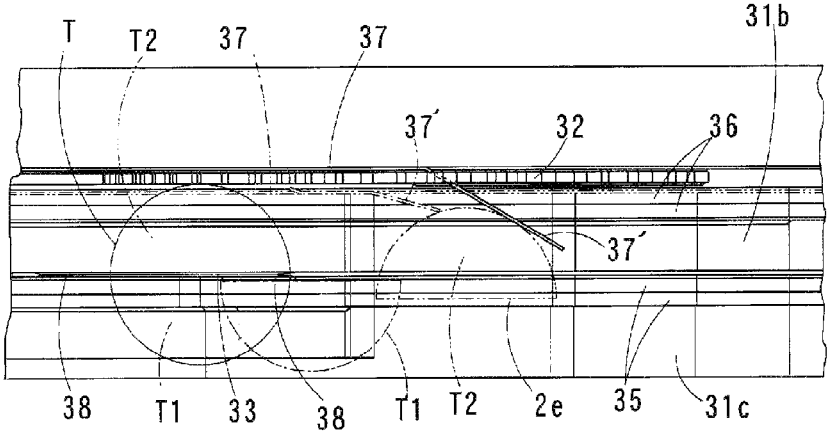
Figure 24:
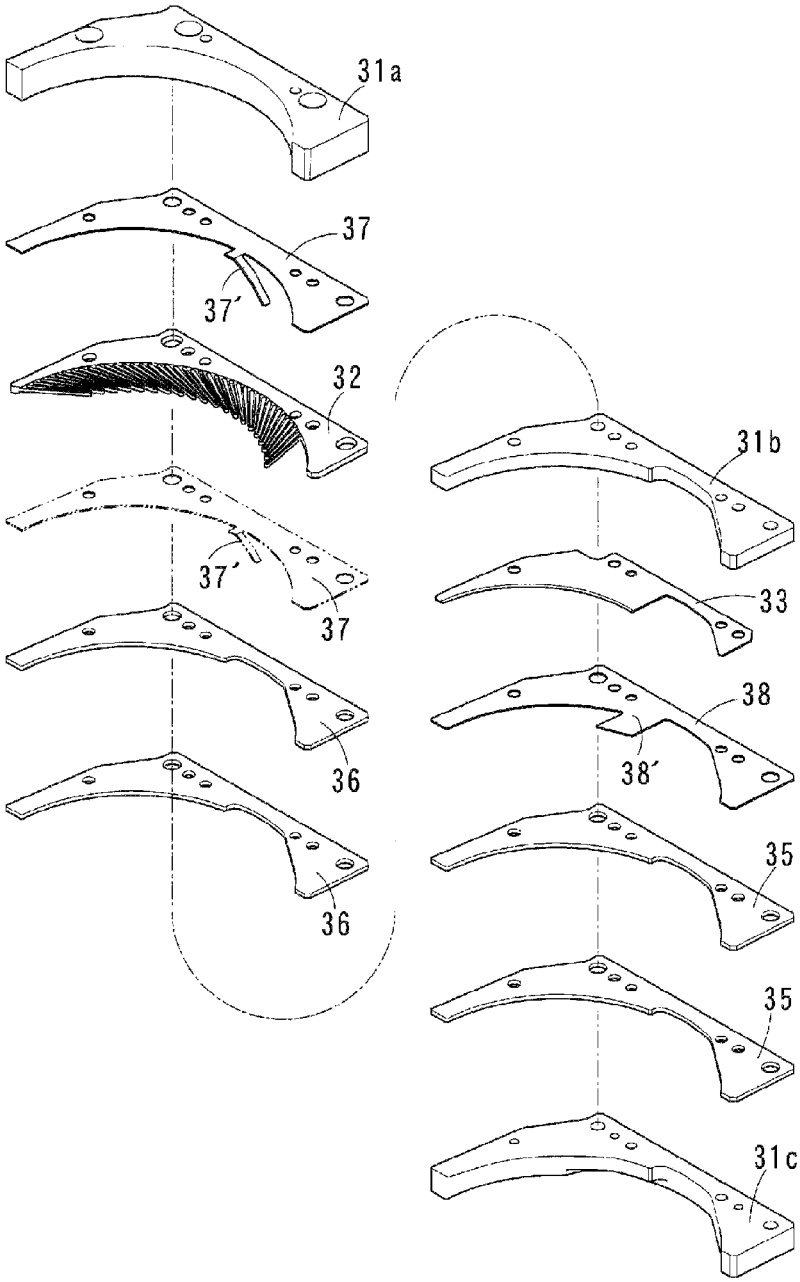
FIG. 24 is an exploded perspective views showing main parts of the tablet divider according to another embodiment of the present invention.
Figure 25:
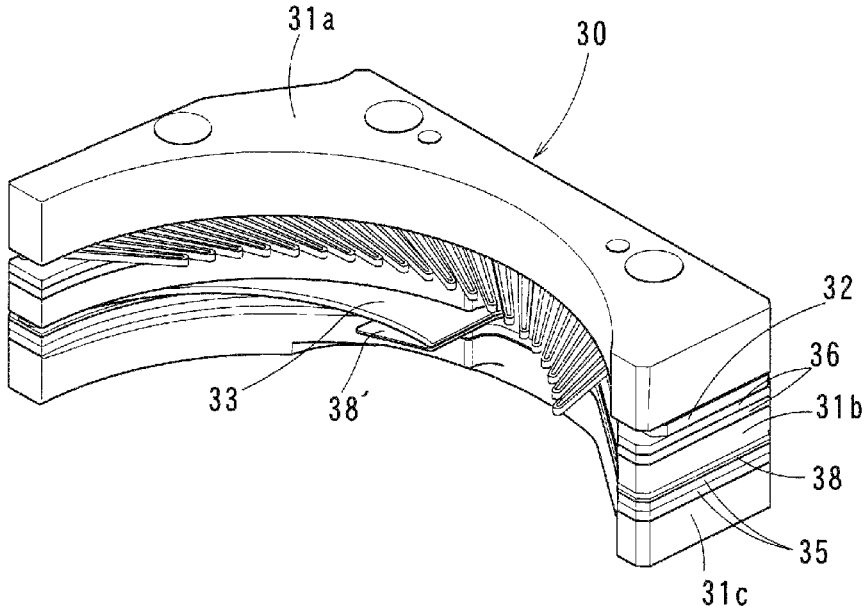
FIG. 25 is a perspective views showing the tablet divider according to another embodiment of the present invention.

FIGS. 23 to 25 show the tablet divider 30 according to another embodiment. The embodiment shown in FIGS. 23 and 24 is similar to the tablet divider 30 shown in FIG. 22 except that the knocking plate for tablets 37 or the separation plate 38 is interposed between the upper flat plate 31*a* of the block 31 and the brush (partition member 32) and between the fixing blade 33 and the spacer 35. When the plates 37 and 38 are assembled with the tablet divider 30, a separation part 38' of the separation plate 38 may overlap with a lower portion of a right end of the fixing blade 33 and a knocking part 37' of the knocking plate 37 protrudes toward a lower portion of a right side of the fixing blade 33, which the fixing blade 33 is not extended, as shown in FIGS. 23(*a*) and 23(*b*).

Thus, when the tablet T is divided into lower and upper half-size tablets T1 and T2 according to the rotation of the rotor 24, as shown in FIGS. 23(*b*), the tablet T is divided at the right end of the fixing blade 23 and the separation part 38' of the separation plate 38 protruding to the tip of the fixing blade 33 is introduced into the divided surface of the tablet T, so the tablet T can be precisely divided into the lower and upper half-size tablets T1 and T2. In addition, the lower half-size tablet T1 is pushed downward by a distance corresponding to the thickness of the separation part 38', so that the lower half-size tablet T1 can be precisely dropped down into the discharge port 27 (see, dashed-dotted line in FIG. 23(*b*)).

In addition, as the upper half-size tablet T2 moves beyond the right end of the fixing blade 33, the upper half-size tablet 12 gradually makes contact with the knocking part 37' of the knocking plate 37, so the upper half-size tablet T2 is pressed (knocked) downward. Thus, the upper half-size tablet T2 can be precisely dropped down into the discharge port 27 (see, two-dot chain line in FIG. 23(*b*)).

Meanwhile, the position of the knocking part 37' or the separation part 38' can be properly selected such that the knocking part 37' or the separation part 38' can perform the above operation. Actually, the knocking part 37' or the separation part 38' is located in various positions by taking the protruding length thereof into consideration. In addition, the knocking plate 37 having the knocking part 37' or the separation plate 38 having the separation part 38' can be located in various positions without being limited to the position between the upper flat plate 31*a* of the block 31 and the brush 32 or between the fixing blade 33 and the spacer 35. For instance, the knocking plate 37 can be installed between the brush 32 and the lower spacer 36 and the separation plate 38 can be installed between the flat plate 31*b* and the fixing blade 33 (top surface of the fixing blade 33), as shown by chain lines. If the knocking plate 37 is installed between the brush 32 and the spacer 36, the knocking part 37' may not pass through the brush 32 (see, FIG. 23(*b*)). If the separation plate 38 is installed on the bottom surface of the fixing blade 33, the lower half-size tablet T1 is pushed by a distance corresponding to the thickness of the separation part 38', as described above, so the lower half-size tablet T1 is remote far from the fixing blade 33, so that the lower half-size tablet T1 can be easily discharged.

In the embodiment shown in FIG. 25, the knocking plate 37 is omitted. In this case, when the rotor 24 is reversely rotated under the specific circumstance, since the knocking part 37' protrudes through the partition member (brush 32), the brush bristle 32*a* can be prevented from being damaged by the reverse operation of the rotor (see, FIG. 23(*b*)).

Figure 26:
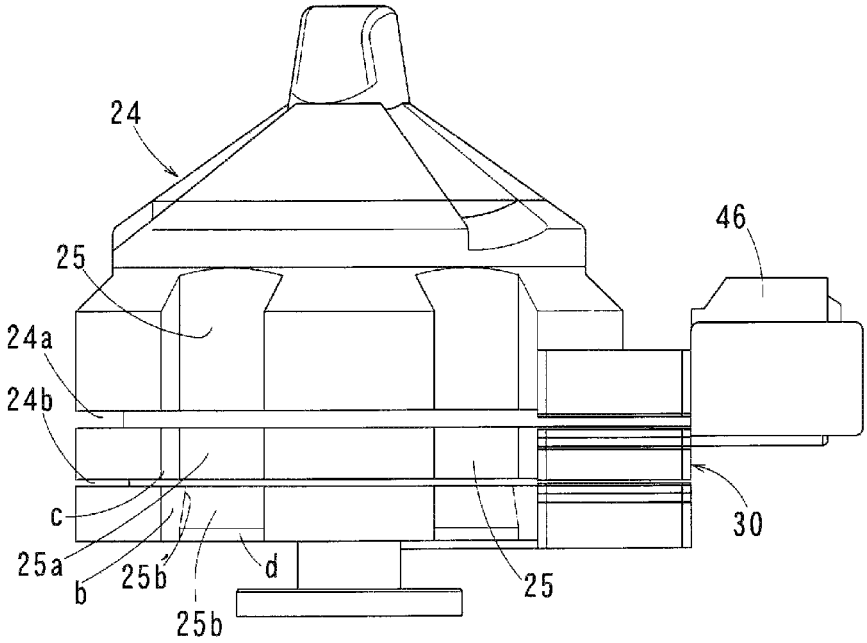
FIG. 26 is a perspective views showing a rotor part according to another embodiment of the present invention.
Figure 27:
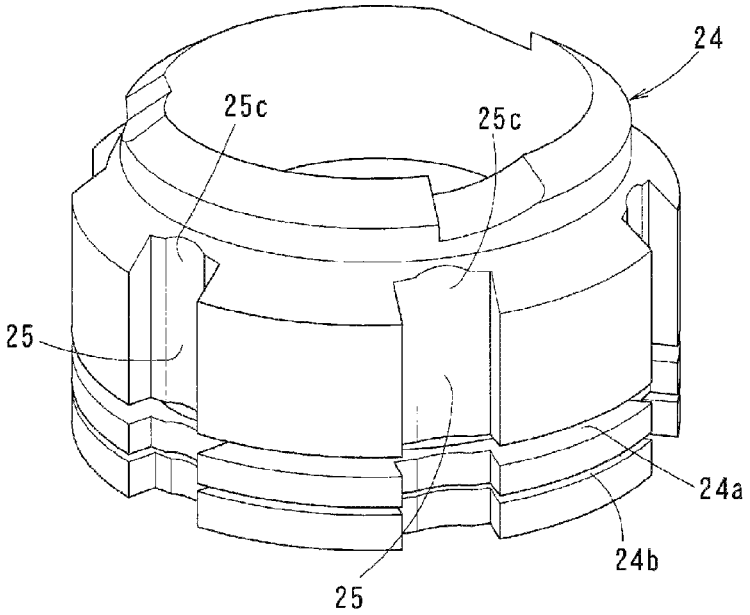
FIG. 27 is a perspective views showing the rotor part, in which a head part is removed, according to another embodiment of the present invention.

FIGS. 26 and 27 show the improvement of the pocket part 25 of the rotor 24. Referring to FIG. 26, the pocket part 25 is divided into a lower bottom portion 25*b* and an upper bottom portion 25*a* about the peripheral groove 24*b* for the fixing blade 23, in which the lower bottom portion 25*b* is located lower (deeper) than the upper bottom portion 25*a* (for instance, about 0.5 mm on the basis of the peripheral groove 24*b*) and can be prepared as an inclined surface gradually directed forward in the downward direction (C-cut).

When the tablet T is divided, a burr may be inserted (fitted) into an end (c in FIG. 26) of the peripheral groove 24*b* for the fixing blade, thereby preventing the lower half-size tablet T1 from dropping down. However, if the pocket part 25 has the C-cut configuration, the burr may be introduced into a receding part 25*b'* of the pocket part 25 without being inserted into the end of the peripheral groove 24*b* for the fixing blade, so that the above problem can be solved. That is, the burr makes contact with a lateral side b of the C-cut configuration, so the burr may not be inserted into the end of the peripheral groove 24*b*.

As shown in FIG. 26, a lower end d of the lower bottom portion 25*b* of the C-cut pocket part 25 is aligned in line with the upper bottom portion 25*a* to have a depth corresponding to a depth of the upper bottom portion 25*a*. The tablet T is guided into the lower end d, so that the tablet T received in the pocket part 25 can be stably and smoothly divided. The longitudinal length of the lower end d is properly selected through experiment by taking the stability of the tablet T and the removal of the burr into consideration.

Meanwhile, since the burr can be easily removed due to the C-cut configuration, the separation plate 38 can be omitted in the embodiment shown in FIG. 25. However, if the burr is inserted into the peripheral groove 24*b* under the specific situation, the lower half-size tablet T1 may not be dropped, so it is preferred to install the separation plate 38.

According to the embodiment shown in FIG. 27, the pocket part 25 has a bottom surface 25*c* recessed in an arc shape when viewed from the top of the pocket part 25. Since the tablet T has an arc-shape surface, the tablet T can be stably fitted in the bottom surface 25*c* of the pocket part 25. Thus, the tablet T can be stably received in the pocket part 25, so the tablet T can be smoothly moved and divided.

Figure 28:
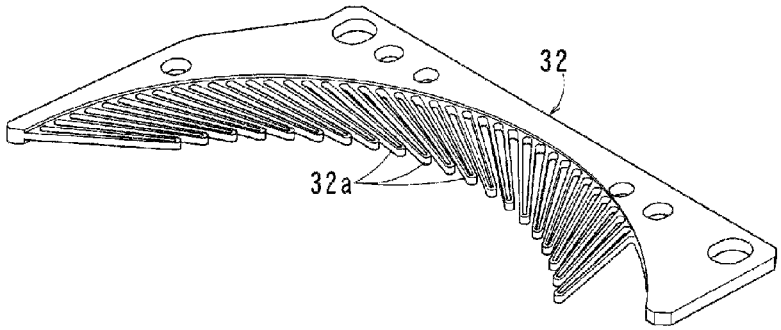
FIG. 28 is a view showing a partition member according to another embodiment of the present invention, in which (a) is a perspective view, (b) is a bottom perspective view, and (c) is an enlarged perspective view of a main part of (b)
Figure 28:
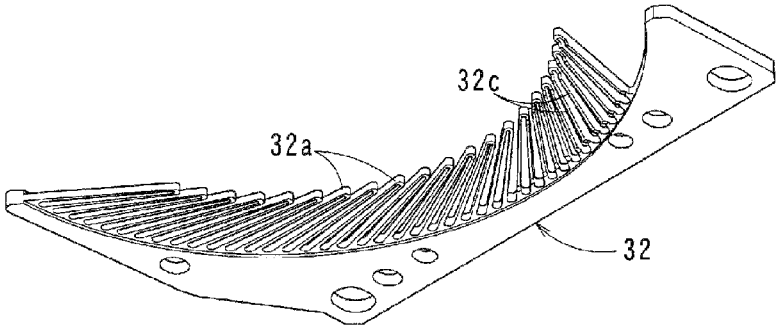
Figure 28:
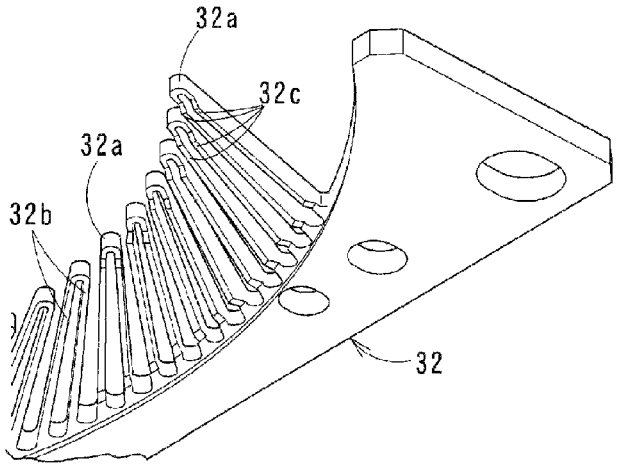

FIG. 28 shows the improvement of the partition member 32. The embodiment shown in FIG. 28 provides the brush bristle (elastic bristle 32*a*). The brush bristle 32*a* can be obtained by connecting end portions of two parallel legs 32*b*, 32*b* with each other in the form of a U shape and forming a protruding strip 32*c* lengthwise along a bottom surface of each leg 32*b* provided at the front of the movement direction of the tablet T (the right side in FIG. 28) (to have a thick thickness).

Therefore, after the tablet T is divided into the lower and upper half-size tablets T1 and T2 by the fixing blade 33, the upper half-size tablet T2 is moved in a state in which the partition member 32 (brush bristle 32*a*) is pushed up due to the protruding strip 32*c*. If the upper half-size tablet T2 moves beyond the front end (right end) of the fixing blade 33 (see, FIG. 12(*d*)), the upper half-size tablet T2 is pushed down due to the pressing force of the brush bristle 32*a*, so that the upper half-size tablet T2 can be smoothly fed. For this reason, the upper knocking plate 37 can be omitted.

It is not necessary to form the protruding strip 32*c* for all brush bristles 32*a*. Preferably, as shown in FIG. 28, the protruding strip 32*c* is formed on the brush bristles 32*a*, which are located after the front end of the fixing blade 33 far from the upper half-size tablet T2 (the right side of FIG. 23). The protruding strip 32*c* can be formed in various positions to the extent that the upper half-size tablet T2 can be stably fed. In addition, the length and the height of the protruding strip 32*c* can be properly selected to the extent that the protruding strip 32*c* can make contact with the upper half-size tablet T2.

Meanwhile, the protruding strip 32*c* formed on the bottom surface of the brush bristles 32*a* of the partition member 32 can be employed in the tablet feeder that supplies the tablets one by one as well as the tablet division feeder.

In addition, at least one of the knocking plate 37, the separation plate 38, the protruding strip 32*c* of the brush bristle 32*a*, and the C-cut configuration of the pocket part 25 can be selectively employed.

Further, in order to drop down the half-size tablets, the following method can be adopted. When the half-size tablets T1 and T2 are not detected in the supply path 14 by the sensor, the rotor 24 is repeatedly rotated in the forward and reverse directions to allow the half-size tablets T1 and T2 received in the recess to be dropped down. To this end, the following can be adopted. Magnets (not shown) are disposed on the surface of the large-size gear 61 rotating the rotor 41 such that the magnets correspond to the recesses 25, and a magnet detecting unit (not shown) is installed on the mounting surface 11*a* of the tablet cassette mounting table 11 in such a manner that the rotation of the rotor 24 can be detected by detecting the magnet that moves according to the rotation of the large-size gear 61. If the sensor installed in the supply path 14 detects the magnet without detecting the half-size tablets T1 and T2, it is determined that the half-size tablets T1 and T2 are blocked or the defect occurs in the tablet cassette 20, so the rotor 24 is repeatedly rotated in the forward and reverse directions. If the sensor detects the half-size tablets T1 and T2 dropped into the supply path 14 after the above operation, it is determined that the half-size tablets T1 and T2 are blocked. In this state, if the half-size tablets T1 and T2 are continuously dropped into the supply path 14, the normal feeding operation is performed. In addition, if the sensor does not detect the half-size tablets T1 and T2 even though the rotor 24 is repeatedly rotated in the forward and reverse directions, it is determined that the defect occurs in the tablet cassette 20, so an alarm message is generated.

In the above embodiments, the fixing blade (cutter 33) is installed in the rotor 24 such that the fixing blade 33 can move back and forth, and the fixing blade 33 is introduced into and withdrawn from the pocket part 25 by a plunger. In this case, the fixing blade 33 is received in the recess (pocket part 25), so that the tablets can be fed one by one. Thus, one and half tablets, three and half tablets or plural tablets and half-size tablets T1 and T2 can be fed by using one tablet feeder A1.

Figure 30:
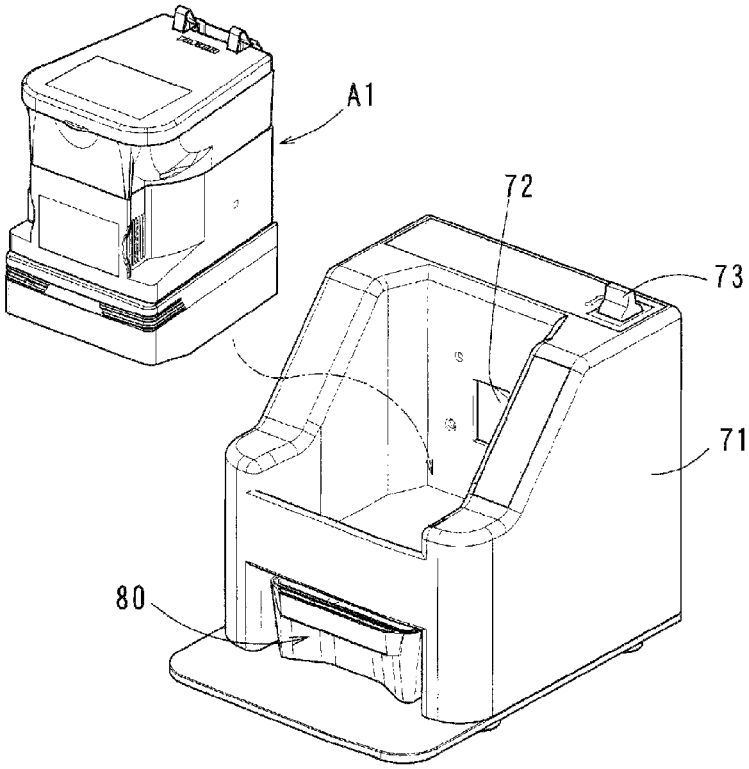
FIG. 30 is an exploded perspective view showing the tablet feeder and a body of the tablet divider according to another embodiment of the present invention.
Figure 31:
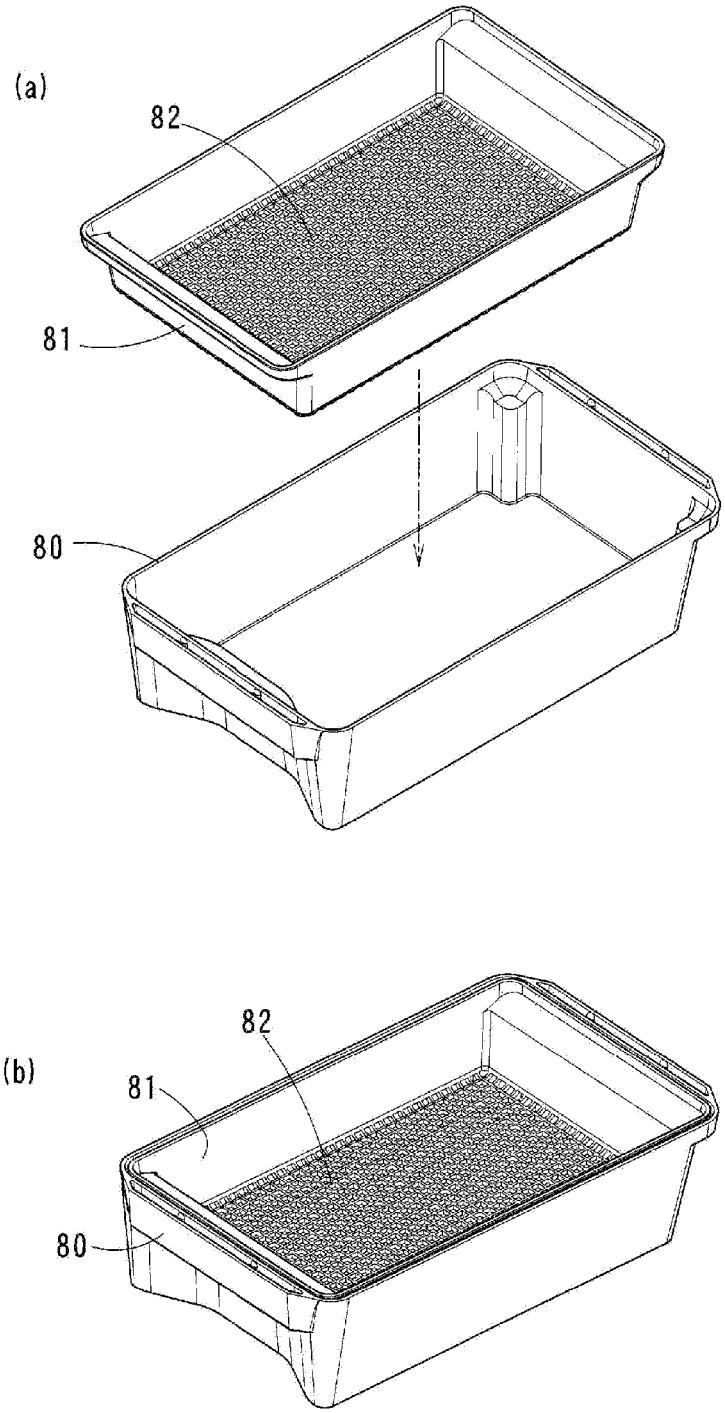
FIG. 31 is a view showing a tablet receptacle, in which (a) is an exploded perspective view, and (b) is a perspective view.

In addition, a bottom surface of the discharge path (the second path 14) adjacent to the motor base is prepared in the form of a bamboo blind (see, porous plate 81 in FIG. 31). In this case, the tablet fragment can be removed from the second path 14. At this time, a receptacle is mounted below the second path 14 to receive the tablet fragment. In addition, a sensor is installed to detect whether the receptacle is normally mounted. If the receptacle is not mounted, the sensor can generate an alarm message if the container is not mounted. Such a sensor can be adopted for a container 80 shown in FIGS. 29, 30 and 31 to detect the container 80 and to generate the alarm message if the container is not mounted, which will be described later.

Figure 29:
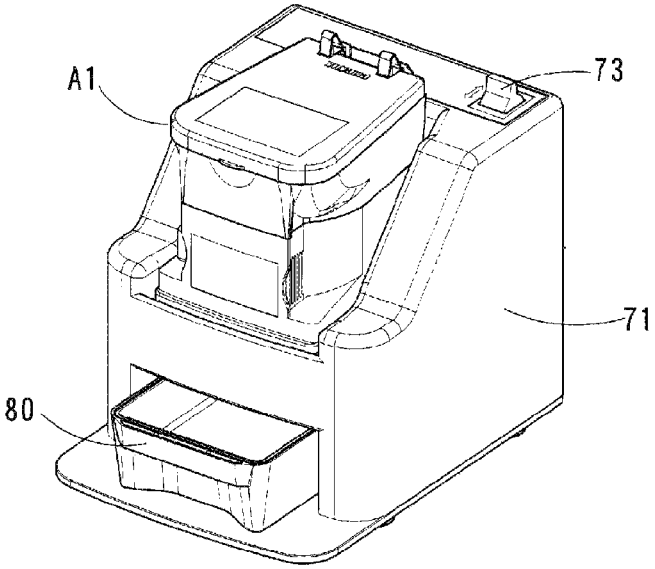
FIG. 29 is a perspective view showing a tablet divider according to another embodiment of the present invention.

The embodiment shown in FIG. 29 provides a tablet divider that simply divides the tablet T into two half-size tablets. A tablet division feeder A1 shown in FIGS. 1, 14, 18, 20 and 22 is installed in a body 71 (see, FIGS. 29 and 30). During the operation of the tablet divider, which is operated by manipulating a switch 73, the tablet division feeder A1 divides the tablet T and feeds the half-size tablets T1 and T2 to a path 72 of the body 71. The structure of the body 71 (mounting table) may vary depending on the structure of the tablet division feeder A1 (see, FIGS. 1, 14 and 20).

The half-size tablets T1 and T2 are dropped from the path 72 into the receptacle 80 shown in FIG. 31. A porous plate (net) 81 is detachably provided at the middle of the receptacle 80. The porous plate 81 is formed with a plurality of pores 82 having a size smaller than the size of the half-size tablets T1 and T2 to prevent the half-size tablets from passing through the porous plate. The tablet fragment (fragments t) can be removed through the porous plate 81, so that the tablet fragment may not adhere to the half-size tablets T1 and T2 placed on the porous plate 81. Instead of the porous plate 81, a fragment removal plate (see, reference numeral 81' of FIG. 33(*a*)) formed with slits having a width (size) sufficient to block the half-size tablets T1 and T2 can be used.

Figure 32:
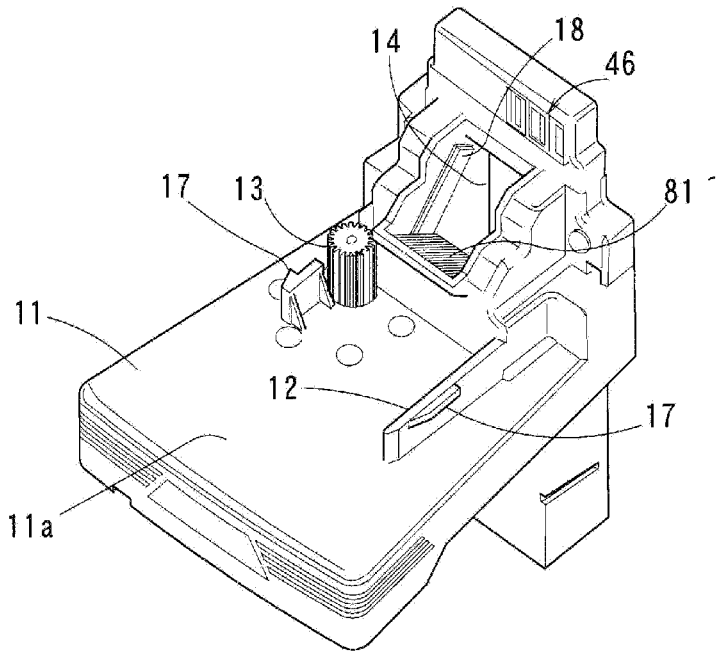
FIG. 32 is a front perspective view showing an example of a motor base according to another embodiment of the present invention.

The porous plate 81 used to remove the tablet fragment can be employed in the discharge (feeding) path of the tablets or the half-size tablets in various pharmaceutical division package devices or tablet division package devices. For instance, as shown in FIGS. 32 and 33, the porous plate 81 having the pores 82 or the fragment removal plate 81' having slits 82' extending in the dropping direction of the tablets can be installed across the path 14. The installation position of the porous plate 81 or the fragment removal plate 81' can be properly set in the middle of the path (14) to the extent that the half-size tablets T1 and T2 placed on the porous plate 81 or the fragment removal plate 81 can be discharged through the tablet feeding port. Preferably, the porous plate 81 or the fragment removal plate 81' is installed on a bottom of the path 14. The porous plate, etc can be fixedly or detachably installed. According to the present embodiment, the position and the shape of the claws 17, etc are different from those described above, so the position and the shape of the tablet cassette 20 must be properly changed corresponding to the position and the shape of the claws 17.

In addition, as shown in FIGS. 32 and 33, a fragment capture unit having a stair structure can be installed to lengthen the path for removing the tablet fragment. The fragment capture unit may include fragment removal plates 81*a*, 81*b* and 81*c*, which are sequentially aligned downward in a zigzag manner. In this case, as the half-size tablets T1 and T2 are dropped onto the fragment capture unit, the fragments t (tablet fragment) are dropped into a discharge path 83 formed at a rear of the fragment removal plates 81*a*, 81*b* and 81*c*, so that the fragments t are collected in a collection pocket 85 provided at a lower portion of a cover 84 without being mixed with the tablets T, T1 and T2. Since the fragments t (the tablet fragments) are collected in the pocket 85, the fragments can be easily discarded. Reference numeral 84*a* is an upper cover. A lower rear portion of the fragment capture unit is covered with the cover 84 and an upper rear portion of the fragment capture unit is covered with the upper cover 84*a*. As shown in FIG. 33(*b*), the fragment capture unit is detachably installed.

Meanwhile, a fragment receptacle is provided below the uppermost fragment removal plate 81', so the tablet fragment may not be dropped onto the lower fragment removal plates 81*a*, 81*b* and 81*c*. As described above, the fragment removal plate 81' can be replaced with the porous plate 81 and the step number of the fragment removal plates 81' or the porous plates 81 is properly selected.

In addition, a sensor can be installed to detect the separation and setting of the porous plate 81, the fragment removal plate 81' or the cover 84. In this case, the tablets are not fed when the sensor transmits the signal notifying the disassembling state. Accordingly, the fragments t (tablet fragment) may not be spread to the peripheral area of the apparatus even if a user forgets to set the porous plate 81, the fragment removal plate 81' or the cover 84 after the user has separated the porous plate 81, the fragment removal plate 81' or the cover 84 for the purpose of cleaning.

Figure 34:
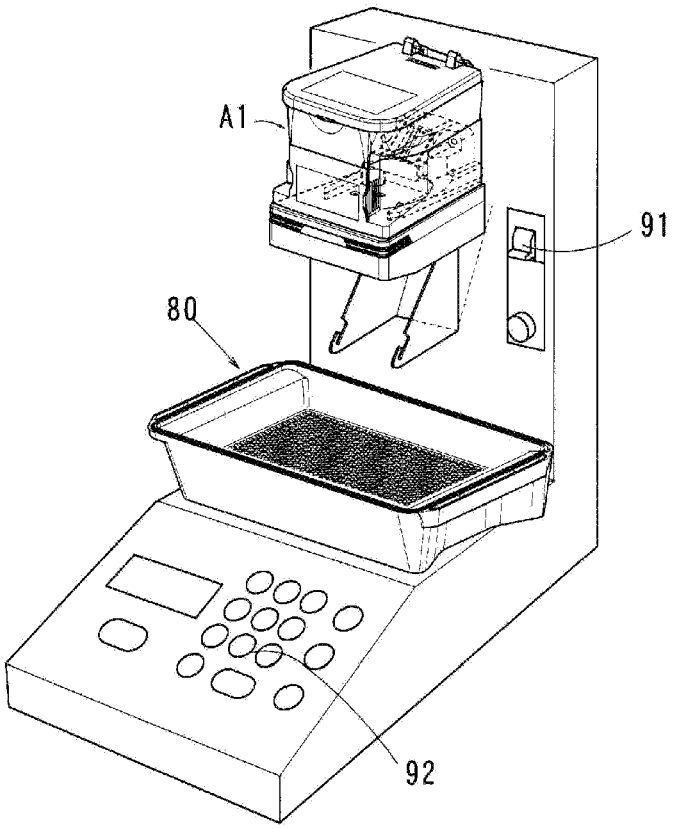
FIG. 34 is a perspective view showing a tablet divider according to another embodiment of the present invention.
Figure 35:
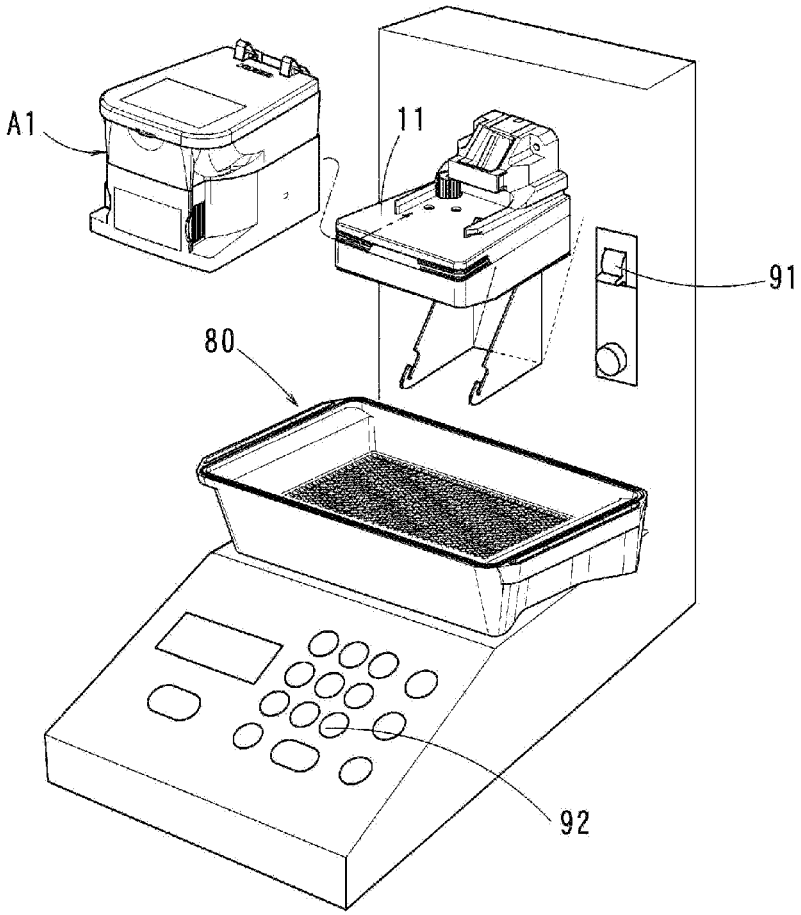
FIG. 35 is an exploded perspective view showing a tablet feeder and a body of the tablet divider according to another embodiment of the present invention.

FIGS. 34 and 35 show another embodiment of the present invention. The present embodiment provides a tablet divider having one of the tablet division feeders A1. The present embodiment is similar to the previous embodiments except that the tablet divider is driven by a switch 91 and the number of the tablets to be fed is set by a ten key 92. The half-size tablets T1 and T2 are received in the receptacle 80. The tablet divider according to the present embodiment can be equipped with a function of counting the tablets T, T1 and T2 based on the supply timing or by using the sensor 19.

Meanwhile, if the fragment removal unit shown in FIGS. 32 and 33 is provided in the tablet division feeder A1 according to the present embodiment or the embodiment shown in FIGS. 29 and 30, the porous plate 81 having the fragment removal function can be omitted from the receptacle 80.

Although the embodiments have been described that the tablet T is divided into two half-size tablets, the tablets T may be divided into at least three tablets. The fixing blades 33 are sequentially installed in the axial direction of the rotor according to the number of divided tablets. For instance, if the tablet T is divided into three tablets, two fixing blades 33 are installed in the longitudinal direction and the length of the support plates (length of the fixing blade 33 in the rotating direction of the rotor) is sequentially lengthened in the rotating direction of the rotor 24 in such a manner that the tables can be sequentially dropped from the support plate (fixing blade 33) into the discharge port 27 as the rotor 24 rotates. Preferably, the tablet is divided such that the divided tablets have the same size.

In addition, although the present invention has been described that two tablets T are received in the recess (pocket part 25) in a row, one or at least three tablets T may be received in the recess. The rotating direction of the rotor 24 may not be limited to the horizontal direction. The rotating direction of the rotor 24 may be inclined to the extent that the effect of the present invention can be achieved.

Further, if the tablet divider 30 is provided in the tablet cassette of the tablet feeder A according to the related art, the tablet division feeder according to the present invention can be obtained. That is, the tablet division feeder according to the present invention can be obtained by installing the tablet divider 30 in the tablet cassette according to the related art.

Meanwhile, according to the tablet charging apparatus to charge the tablets T by feeding the tablets T to the vial container shown in FIG. 39, if a device for rotating the rotor 24 is not the motor base, such as the mounting table 11, a separate driving unit is provided to rotate the rotor 24.

In addition, the tablet division feeder A1 can be employed in various apparatus, such as the pharmaceutical supply apparatus or the pharmaceutical charging apparatus. Further, if the tablet feeder feeds the tablets one by one without dividing the tablet in the above apparatus, the tablet divider 30 can be omitted. In this case, the tablet detecting sensor 40 may be installed on the cassette body, other than the frame (block 31) of the tablet divider 30.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

The invention claimed is:

1. A tablet division feeder comprising:

a moving unit to move a tablet T;

a fixing blade located in a movement path of the tablet T; and a support plate extending from the fixing blade such that divided tablets T2 on the fixing blade are transferred and kept onto the support plate, wherein the fixing blade divides the tablet T into upper and lower divided tablets as the tablet T is moved in such a manner that the lower divided tablet T1 is discharged and the upper divided tablet T2 is transferred and kept on the support plate, and the upper divided tablet T2 is discharged from the support plate as the upper divided tablet T2 is further moved; and wherein the moving unit includes a rotor, which is installed in a container for receiving a plurality of tablets T such that a rotating shaft of the rotor is longitudinally arranged in the container, recesses are formed in an axial direction of the rotor along an entire lateral side of the rotor at a regular interval to receive the tablets T, a rotor receiving part of the container has a tablet discharge port, the fixing blade and the support plate are installed outside the rotor receiving part, a peripheral groove is formed along an entire lateral side of the rotor such that the fixing blade and the support plate are inserted into the peripheral groove, the fixing blade divides the tablet T, which is accommodated in the recess and moves while being guided along an inner wall of the rotor receiving part as the rotor rotates, in such a manner that the lower divided tablet T1 is discharged through the discharge port and the upper divided tablet T2 is transferred to and kept on the support plate extending from the fixing blade from a top surface of the fixing blade, and the upper divided tablet T2 is discharged from the support plate to the discharge port as the rotor is further rotated.

2. The tablet division feeder of claim 1, wherein a bottom surface of the recess is concaved in an arc shape when viewed in a plan view.

3. The tablet division feeder of claim 1, wherein the recess is divided into a lower bottom portion and an upper bottom portion about a peripheral groove of the rotor for the fixing blade, and the lower bottom portion is deeper than the upper bottom portion and is prepared as an inclined surface gradually directed forward in a downward direction.

4. The tablet division feeder of claim 3, wherein a lower end of the lower bottom portion of the recess has a surface level identical to a surface level of the upper bottom portion.

5. The tablet division feeder of claim 1, wherein the fixing blade has a flake shape, and a tip of the fixing blade gradually protrudes toward the rotor in a movement direction of the tablet.

6. The tablet division feeder of claim 5, wherein the tip of the fixing blade is concaved in an arc shape against the rotor.

7. The tablet division feeder of claim 1, further comprising a lower guide installed below the fixing blade at an outside of the rotor receiving part to align the tablet T in a desired position for the fixing blade when the tablet T is divided by the fixing blade.

8. The tablet division feeder of claim 1, wherein the lower guide includes a spring plate, and an eating clearance of the fixing blade for the tablet T is compensated by flexure of the lower guide when the tablet T is divided by the fixing blade.

9. The tablet division feeder of claim 1, further comprising an elastic guide plate for pressing the tablet T downward, wherein the eating clearance of the fixing blade for the tablet T is compensated by flexure of the elastic guide plate when the tablet T is divided by the fixing blade.

10. The tablet division feeder of claim 9, wherein the tablets are received in the recesses in multiple steps, and the elastic guide plate is introduced between a lowest tablet T to be divided by the fixing blade and a tablet T located very above the lowest tablet T to partition the tablet T from the lowest tablet T.

11. The tablet division feeder of claim 9, wherein the guide plate includes a brush having elastic bristles arranged in parallel to each other, a protruding strip is installed on a bottom surface of the elastic bristle arranged after the support plate in a rotating direction of the rotor such that the protruding strip pushes down the upper divided tablet positioned away from the support plate.

12. The tablet division feeder of claim 10, wherein an installation height of the fixing blade and the guide plate is adjustable by positioning spacers between the fixing blade and a support part thereof and between the guide plate and a support part thereof, and a division position of the tablet T is adjustable by adjusting the installation height according to a size and a shape of the tablet T.

13. The tablet division feeder of claim 1, further comprising a separation plate having a separation part, wherein the separation part makes contact with the fixing blade and is introduced between upper and lower divided tablets T1, T2 to separate the upper and lower divided tablets from each other.

14. The tablet division feeder of claim 1, further comprising a motor installed on a mounting table of the container and a pinion installed on an edge of a mounting surface of the mounting table for the container and rotated by the motor, wherein a rotating shaft of the rotor protrudes through a bottom surface of the container, a large-size gear to be engaged with the pinion is installed to an end of the rotating shaft of the rotor, and the large-size gear is engaged with the pinion when the container is mounted on the mounting table.

15. The tablet division feeder of claim 1, wherein the rotating shaft of the rotor is rotatably supported by a bearing unit installed on the bottom surface of the container, and the bearing unit includes a pair of thrust bearings, which are arranged in a longitudinal direction to support the rotating shaft of the rotor.

16. The tablet division feeder of claim 1, further comprising a disc integrally fixed to the rotating shaft of the rotor while being arranged concentrically with the rotating shaft of the rotor, wherein concavo-convex sections are formed on an entire peripheral portion of the disc at a regular interval corresponding to the recesses of the rotor so that rotation of the rotor is detected by detecting the concavo-convex sections.

17. The tablet division feeder of claim 1, wherein the support plate includes the fixing blade.

18. The tablet division feeder of claim 1, further comprising a tablet detecting sensor to detect the upper divided tablet T2 kept on the support plate after the tablet has been divided.

19. The tablet division feeder of claim 18, wherein the tablet detecting sensor includes an arm installed at an attachment block with respect to the rotor receiving section of the fixing blade, and a sensor to detect a fluctuation of the arm, the arm includes a wiper positioned at a head point of the fluctuation and located in a movement path of the tablet T received in the recess of the rotor, the tablet makes contact with the wiper as the tablet is moved so that the tablet exerts an action on the arm, and the sensor detects the tablet T according to the action of the arm.

20. The tablet division feeder of claim 19, wherein the rotor is formed on an entire lateral side thereof with a peripheral groove into which the wiper is inserted, the wiper inserted into the peripheral groove is located in the movement path of the tablet T and pressed according to the movement of the tablet T received in the recess so that the arm is fluctuated, and the sensor detects the tablet T according to the fluctuation of the arm.

21. A tablet cassette comprising a container detachably mounted on a mounting table in a tablet division feeder claimed in claim 1.

* * * * *